US010093090B2

(12) United States Patent
Yamashita

(10) Patent No.: US 10,093,090 B2
(45) Date of Patent: Oct. 9, 2018

(54) CONTROL SYSTEM, HEAD MODULE AND PRINTING APPARATUS FOR CONTROLLING DRIVING ELEMENTS TO EJECT LIQUID

(71) Applicant: BROTHER KOGYO KABUSHIKI KAISHA, Nagoya-shi, Aichi-ken (JP)

(72) Inventor: Toru Yamashita, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/706,089

(22) Filed: Sep. 15, 2017

(65) Prior Publication Data

US 2018/0079205 A1 Mar. 22, 2018

(30) Foreign Application Priority Data

Sep. 16, 2016 (JP) ..... 2016-181980

(51) Int. Cl.
*B41J 2/045* (2006.01)
*B41J 29/38* (2006.01)

(52) U.S. Cl.
CPC ..... *B41J 2/04541* (2013.01); *B41J 2/0457* (2013.01); *B41J 2/04581* (2013.01); *B41J 29/38* (2013.01)

(58) Field of Classification Search
CPC ..... B41J 2/04581; B41J 2/04541; B41J 2/04593; B41J 2/0458; B41J 2/04573; B41J 2/04595; B41J 2/04548; B41J 2/04551; B41J 2/04501; B41J 2/0452; B41J 2/0455; B41J 2/0457
See application file for complete search history.

(56) References Cited

U.S. PATENT DOCUMENTS 8,894,171 B2 * 11/2014 Endo ..... B41J 2/04516 347/10
2010/0315455 A1 * 12/2010 Sakurai ..... B41J 2/04541 347/10

FOREIGN PATENT DOCUMENTS

JP 2006-256220 A 9/2006

* cited by examiner

*Primary Examiner* — Thinh H Nguyen
(74) *Attorney, Agent, or Firm* — Merchant & Gould P.C.

(57) ABSTRACT

A control system includes a control circuit. The control circuit is to be connected to a head unit including first driving elements and second driving elements. Based on an input print data, the control circuit applies a first signal to the first driving element and applies a second signal to the second driving elements. The control circuit changes the first signal to a third signal in a first time and changes the second signal to a fourth signal in a second time. Based on an input print data, the control circuit applies the third signal to the first driving element and applies the fourth signal to the second driving elements.

28 Claims, 16 Drawing Sheets

Fig.8

| NOZZLE ADDRESS | RANK | DRIVING VOLTAGE [V] |
|---|---|---|
| 1 | E | 27.6 |
| ⋮ | ⋮ | ⋮ |
| 500 | C | 26.0 |
| ⋮ | ⋮ | ⋮ |
| 1000 | A | 24.4 |
| ⋮ | ⋮ | ⋮ |
| 1200 | B | 25.2 |
| ⋮ | ⋮ | ⋮ |
| 1500 | D | 26.8 |
| ⋮ | ⋮ | ⋮ |
| 1680 | E | 27.6 |

Fig.9

| RANK | NUMBER OF NOZZLES | DRIVING VOLTAGE [V] | POWER SUPPLY NUMBER |
|---|---|---|---|
| A | 10 | 24.4 | 4 |
| B | 350 | 25.2 | 3 |
| C | 800 | 26.0 | 1, 5 |
| D | 500 | 26.8 | 2 |
| E | 20 | 27.6 | 6 |

Fig.12

| CUMULATIVE VALUE | CORRECTION VALUE | CORRECTION TIME |
|---|---|---|
| ⋮ | ⋮ | ⋮ |
| -0.4～-0.3 | -0.15 | 0.03 |
| -0.3～-0.2 | -0.1 | 0.02 |
| -0.2～-0.1 | -0.05 | 0.01 |
| 0.1～0.2 | 0.05 | 0.01 |
| 0.2～0.3 | 0.1 | 0.02 |
| 0.3～0.4 | 0.15 | 0.03 |
| ⋮ | ⋮ | ⋮ |

Fig.15

| NUMBER OF NOZZLES | DRIVING VOLTAGE [V] | POWER SUPPLY NUMBER | NUMBER OF IN-USE NOZZLES |
|---|---|---|---|
| 10 | 24.4 | 4 | 0 |
| 350 | 25.2 | 3 | 300 |
| 800 | 26.0 | 1 | 400 |
| 800 | 26.0 | 5 | 450 |
| 500 | 26.8 | 2 | 250 |
| 20 | 27.6 | 6 | 5 |

CONTROL SYSTEM, HEAD MODULE AND PRINTING APPARATUS FOR CONTROLLING DRIVING ELEMENTS TO EJECT LIQUID

CROSS-REFERENCE TO RELATED APPLICATION

This application claims priority from Japanese patent Application No. 2016-181980 filed on Sep. 16, 2016, the content of which is incorporated herein by reference in its entirety.

FIELD OF DISCLOSURE

The disclosure relates to a control system, a head module, a printing apparatus and a method for controlling driving elements to eject liquid.

BACKGROUND

Hitherto, inkjet heads have been disclosed which include a liquid droplet ejection control device that controls ejection of ink and a temperature sensor that detects temperature of the ink. Based on the temperature detected by the temperature sensor, the liquid droplet ejection control device collectively and simultaneously corrects voltages to be applied to a plurality of piezoelectric elements used to eject the ink.

However, in the case where correction is collectively and simultaneously performed for all the piezoelectric elements, a boundary between a portion printed before the correction and a portion printed after the correction can be distinctly seen on a material subjected to printing, such as paper. In particular, in the case where the aforementioned liquid droplet ejection control device is used in industrial printers, since time taken for a single printing process is longer in industrial printers than in home printers, a larger temperature change occurs during the printing process and consequently the boundary is more likely to be distinct.

SUMMARY

The disclosure has been made in view of such a circumstance, and it is an object of the disclosure to provide a technique for making the boundary less distinct on a material subjected to printing even when signals to be supplied to respective driving elements used to eject liquid are changed or corrected.

BRIEF DESCRIPTION OF THE DRAWINGS

FIG. 8 is a schematic diagram illustrating an example of a first table that represents a correspondence among a nozzle address, a rank, and a driving voltage.

FIG. 9 is a schematic diagram illustrating an example of a second table indicating assignment of the power supply circuits.

FIG. 12 illustrates a third table that is stored in a non-volatile memory and that indicates a temperature change, a correction value, and a correction time.

FIG. 15 is a schematic diagram illustrating an example of a fourth table that represents relationships between the number of nozzles in use and the respective power supply circuits.

DETAILED DESCRIPTION

First Embodiment

A printing apparatus according to a first embodiment will be described below with reference to the accompanying drawings.

Figure 1:
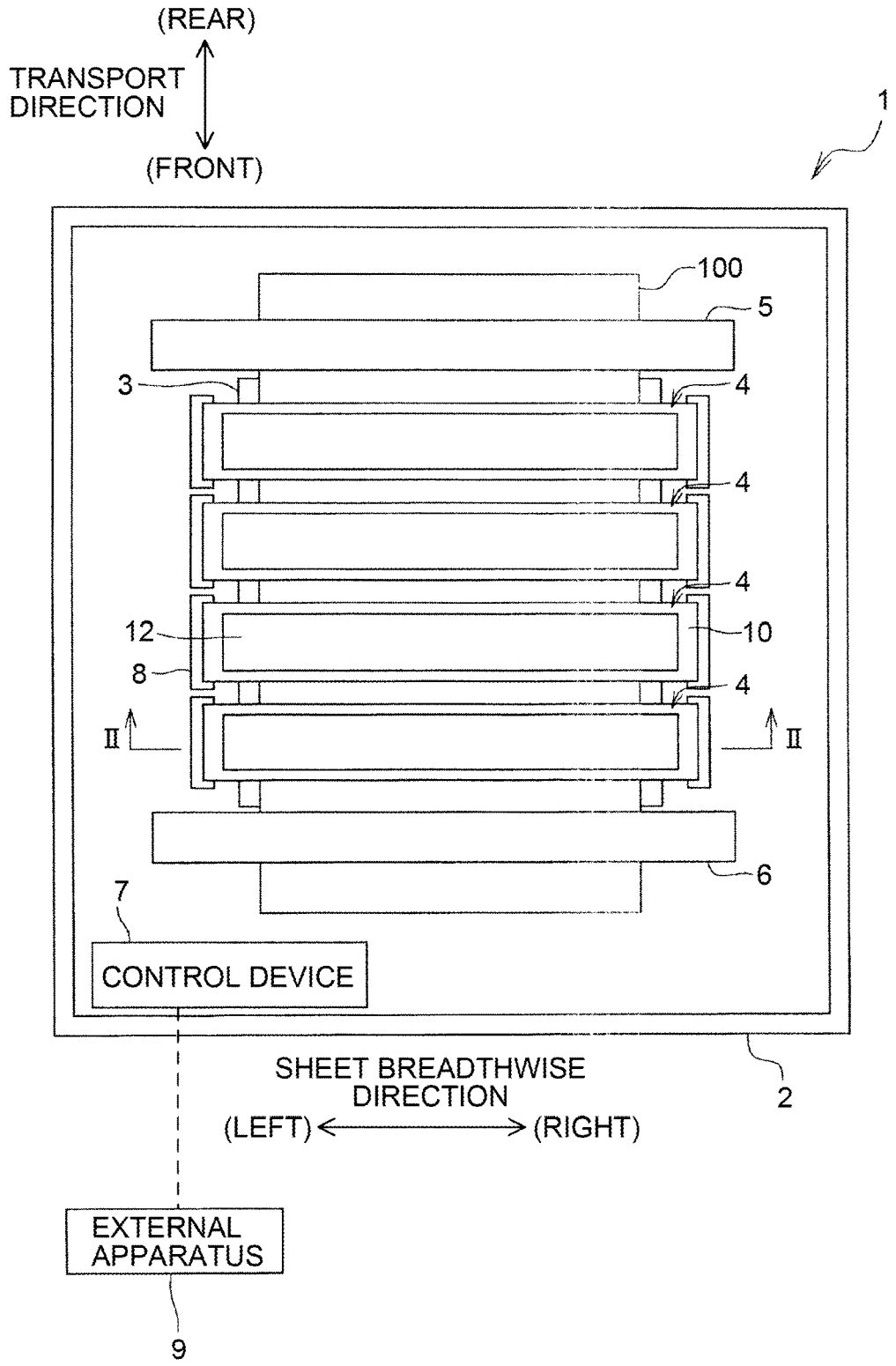
FIG. 1 is a plan view schematically illustrating a printing apparatus according to a first embodiment.

Referring to FIG. 1, the downstream and upstream sides in the transport direction of a recording sheet 100 are defined as front and rear sides of a printing apparatus 1, respectively. In addition, a sheet breadthwise direction that is parallel to a surface on which the recording sheet 100 is transported (surface parallel to the sheet surface of FIG. 1) and that is perpendicular to the transport direction is defined as a left-right direction of the printing apparatus 1. Note that the left side of FIG. 1 is the left side of the printing apparatus 1 and the right side of FIG. 1 is the right side of the printing apparatus 1. Further, a direction that is perpendicular to the transportation surface of the recording sheet 100 (direction perpendicular to the sheet surface of FIG. 1) is defined as an up-down direction of the printing apparatus 1. The front side of FIG. 1 is the up side, and the back side of FIG. 1 is the down side. Hereinafter, a description is given by appropriately using "front", "rear", "left", "right", "up", and "down".

As illustrated in FIG. 1, the printing apparatus 1 includes a housing 2, a platen 3, four inkjet heads 4, two transport rollers 5 and 6, and a controller, or control device 7.

The platen 3 is disposed inside the housing 2. The platen 3 has an upper surface, which supports the recording sheet 100. The four inkjet heads 4 are arranged in the front-rear direction above the platen 3. The two transport rollers 5 and 6 are disposed on the rear side and the front side relative to the platen 3, respectively. The two transport rollers 5 and 6 are each driven by a motor (not illustrated) and transport the recording sheet 100 on the platen 3 toward the front.

The control device 7 includes a plurality of field programmable gate arrays (FPGAs) 71*a* and 72*a* (see FIG. 4), a read-only memory (ROM), a random access memory (RAM), and a non-volatile memory (electrically erasable programmable read-only memory (EEPROM), for example). Note that the ROM, the RAM, and the non-volatile memory are not illustrated. In addition, the control device 7 is connected to an external apparatus 9, such as a personal computer (PC), to be able to perform data communication. The control device 7 controls each unit of the printing apparatus 1 on the basis of print data transmitted from the external apparatus 9.

For example, the control device 7 controls the inkjet heads 4 to eject liquids (inks in this embodiment) toward the recording sheet 100 while controlling the motors that drive the transport rollers 5 and 6 to cause the transport rollers 5 and 6 to transport the recording sheet 100 in the transport direction. In this way, an image is printed on the recording sheet 100.

A plurality of head holders 8 are disposed in the housing 2. The plurality of head holders 8 are arranged in the front-rear direction between the two transport rollers 5 and 6 above the platen 3. Each of the head holders 8 holds a corresponding one of the inkjet heads 4.

Each of the four inkjet heads 4 ejects a corresponding one of inks of four colors, i.e., cyan (C), magenta (M), yellow (Y), and black (K). Each of the inkjet heads 4 is supplied with the ink of the corresponding color from a corresponding ink tank (not illustrated).

Figure 2:
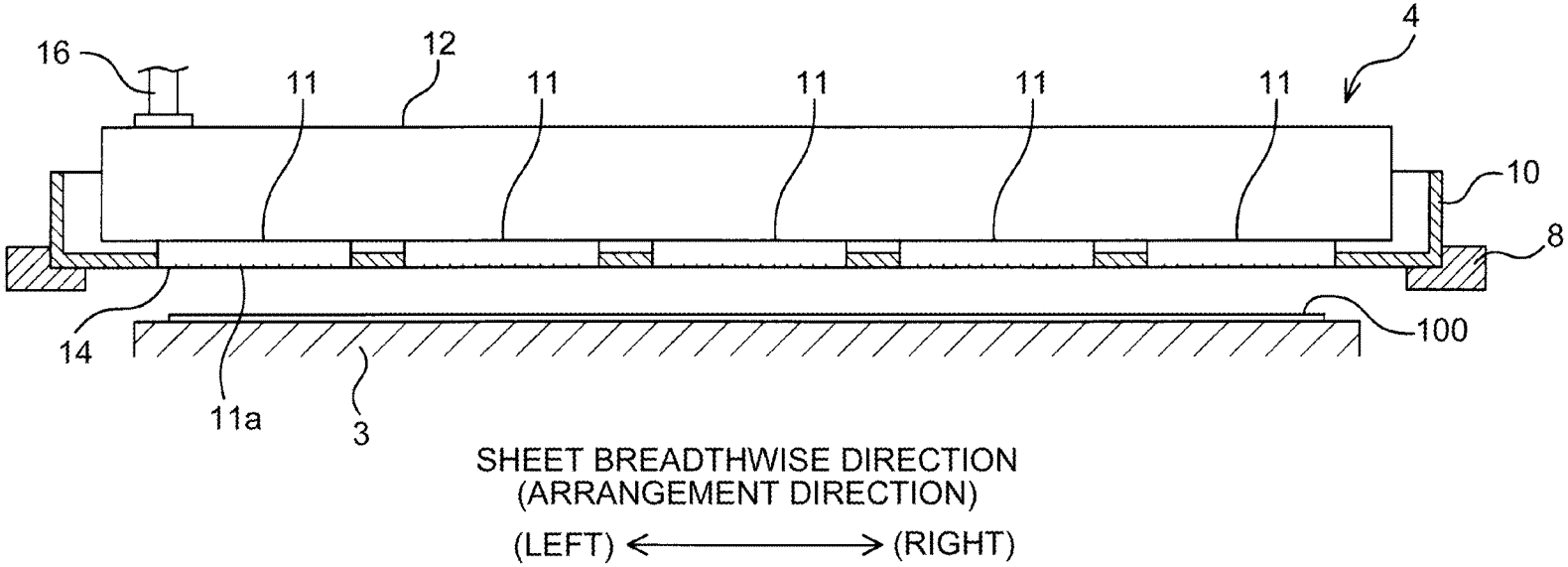
FIG. 2 is a schematic cross-sectional view of the printing apparatus taken along line II-II illustrated in FIG. 1.
Figure 3:
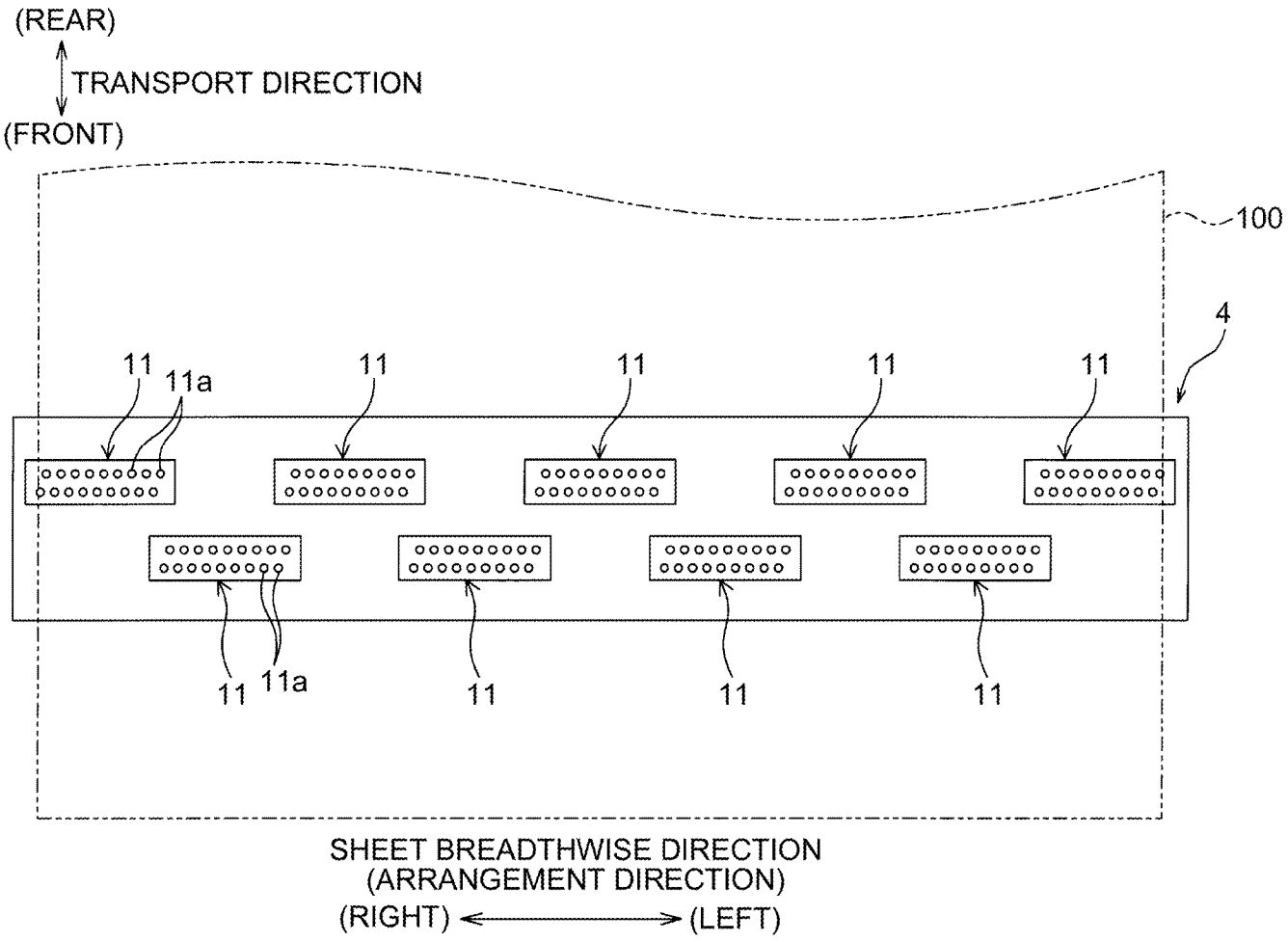
FIG. 3 is a bottom view of an inkjet head.

As illustrated in FIGS. 2 and 3, each of the inkjet heads 4 includes a holder 10 and a plurality of head units 11. The holder 10 has a rectangular plate-like shape that elongates in the sheet breadthwise direction. The holder 10 holds the plurality of head units 11. In the holder 10, the plurality of head units 11 are arranged in the left-right direction and arranged in two lines in the front-rear direction. The plurality of head units 11 are arranged in a staggered pattern.

Figure 6:
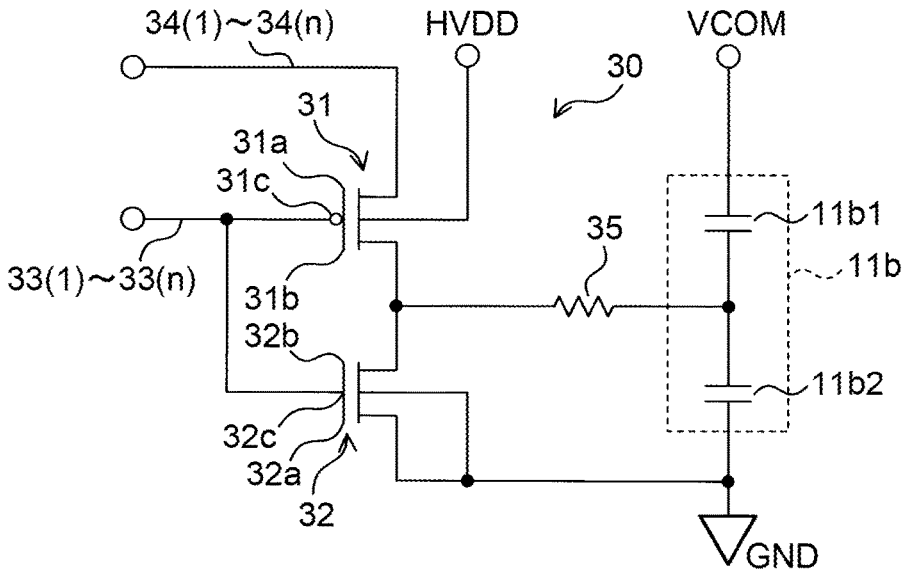
FIG. 6 is a circuit diagram schematically illustrating a configuration of a complementary metal oxide semiconductor (CMOS) circuit that drives a driving element.

A plurality of nozzles 11*a* are formed on the lower surface of each of the head units 11, and each of the nozzles 11*a* has a corresponding piezoelectric driving element 11*b* associated therewith The driving elements 11*b* each have piezoelectric bodies 11*b*1 and 11*b*2 (see FIG. 6). The plurality of nozzles 11*a* of each of the head units 11 are arranged in the left-right direction. The piezoelectric bodies 11*b*1 and 11*b*2 form part of a wall of a storage chamber (not illustrated) that stores the ink, and the nozzles 11*a* are formed on a bottom surface of the storage chamber. Liquid is ejected from the nozzles 11*a* as a result of the piezoelectric bodies 11*b*1 and 11*b*2 being driven.

The head units 11 and the control device 7 are connected to each other via a flexible board (not illustrated). In this embodiment, the plurality of head units 11 are arranged in a direction (sheet breadthwise direction) perpendicular to the transport direction. However, the plurality of head units 11 may be arranged in a direction that crosses the transport direction at an angle other than 90 degrees, that is, may be arranged diagonally.

As illustrated in FIGS. 1 and 2, a plurality of reservoirs 12 are each located above the plurality of head units 11. Note that the reservoirs 12 are not illustrated in FIG. 3.

Each of the reservoirs 12 is connected to a corresponding ink tank (not illustrated) via a tube 16 and temporarily stores the ink supplied from the corresponding ink tank. The lower portion of the reservoir 12 is connected to the plurality of head units 11, and the ink is supplied from the reservoir 12 to each of the head units 11.

Figure 4:
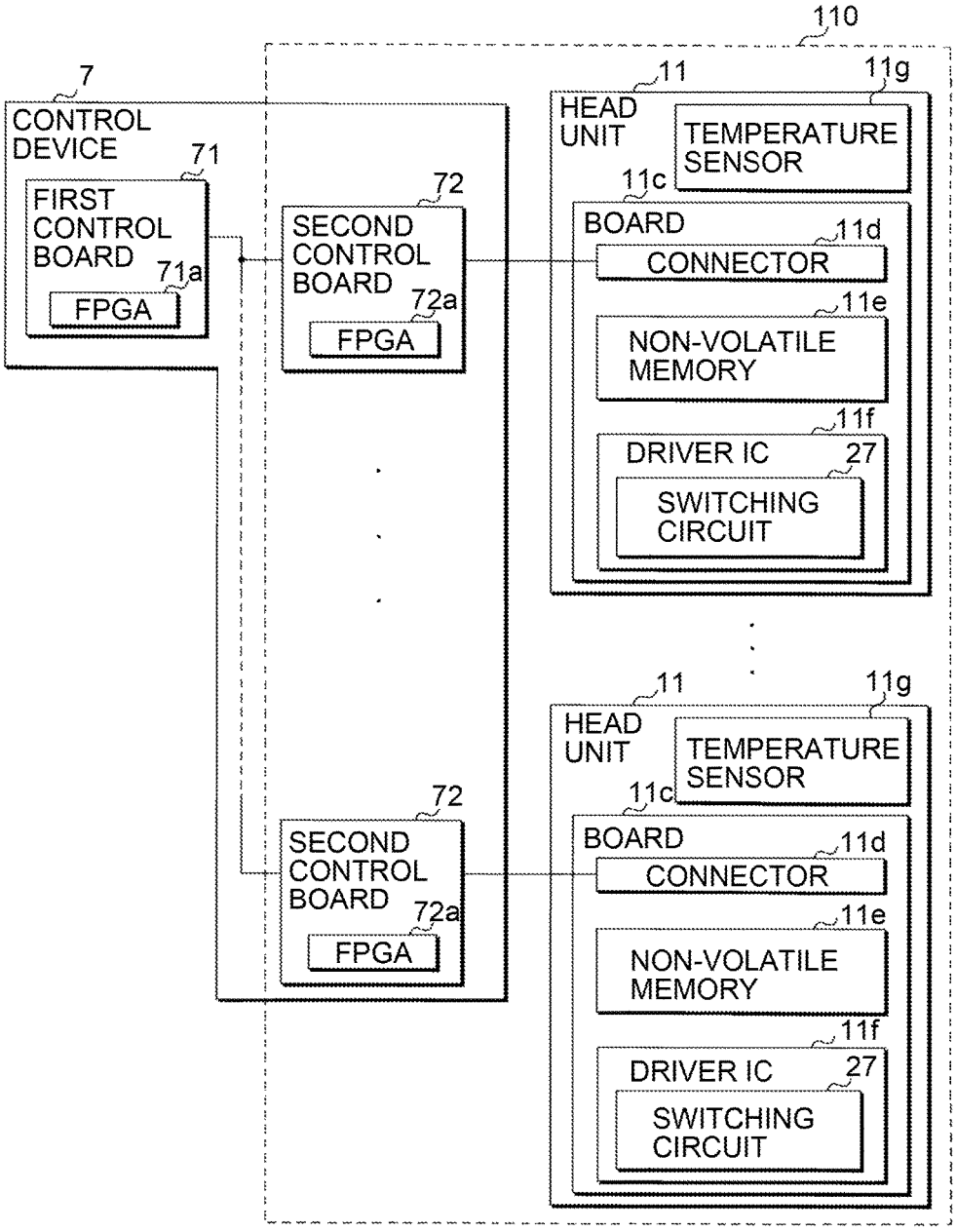
FIG. 4 is a block diagram schematically illustrating connections between a control device and head units.

As illustrated in FIG. 4, the control device 7 includes a first control board 71 and a plurality of second control boards 72 (control boards). The first control board 71 includes the FPGA 71*a*. Each of the second control boards 72 includes the FPGA 72*a* (control circuit). The FPGA 71*a* is connected to each of the plurality of FPGAs 72*a* and controls driving of the plurality of FPGAs 72*a*.

The plurality of second control boards 72, that is, the plurality of FPGAs 72*a*, and the plurality of head units 11 have a one-to-one correspondence. That is, the number of FPGAs 72*a* is equal to the number of head units 11. Each of the plurality of FPGAs 72*a* and a corresponding one of the plurality of head units 11 are connected to each other. The FPGA 71*a* and the FPGAs 72*a* are connected to a ROM (not illustrated) storing bitstream information and a RAM (not illustrated). FIG. 4 illustrates a head module 110 that includes at least one of the second control boards 72 and at least one of the corresponding head units 11.

Each of the head units 11 includes a board 11*c*. The board 11*c* includes a connector 11*d*, a non-volatile memory 11*e*, and a driver integrated circuit (IC) 11*f*. The head unit 11 is removably connected to the corresponding second control board 72 via the connector 11*d*. The driver IC 11*f* includes a switching circuit 27 (described later). Each of the head units 11 further includes a temperature sensor 11*g* for detecting temperature of the ink.

Figure 5:
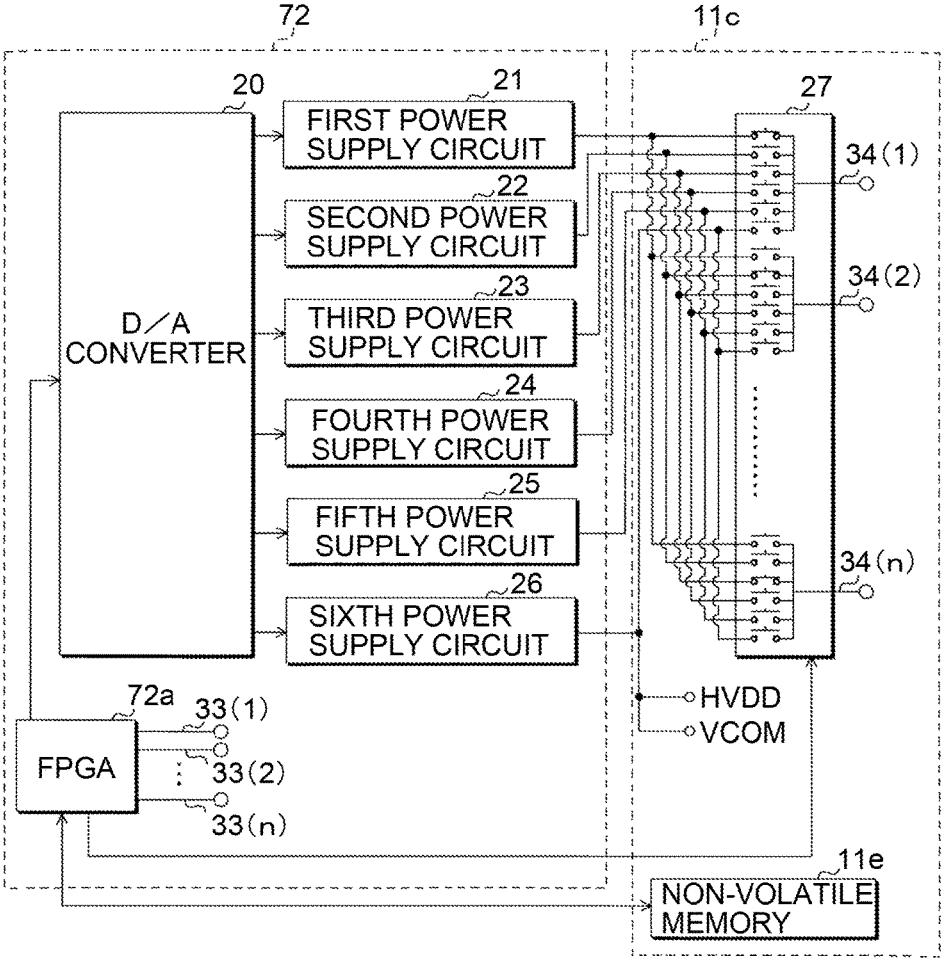
FIG. 5 is a block diagram schematically illustrating a configuration of a portion of a second control board around power supply circuits.

As illustrated in FIG. 5, the second control board 72 includes a digital/analog (D/A) converter 20. The second control board 72 also includes a plurality of power supply circuits, for example, a first power supply circuit 21 to a sixth power supply circuit 26. Note that the power supply circuits equate with power supplies. Each of the first to sixth power supply circuits 21 to 26 includes elements, such as a field-effect transistor (FET) and a resistor, and is capable of changing the output voltage. For example, each of the first to sixth power supply circuits 21 to 26 is a switching-type DC/DC converter. The FPGA 72*a* outputs signals for setting the output voltage to the first to sixth power supply circuits 21 to 26 via the D/A converter 20.

Each of a first power supply line 34(1) to an n-th power supply line 34(*n*) (where n is a natural number greater than or equal to 2) is connected to any one of the first to sixth power supply circuits 21 to 26 via the switching circuit 27. The switching circuit 27 connects each of the first to n-th power supply lines 34(1) to 34(*n*) to any one of the first to sixth power supply circuits 21 to 26. The first to fourth power supply circuits 21 to 24 are ordinary power supply circuits that are used in an ordinary situation. The fifth power supply circuit 25 is an ordinary power supply circuit or a backup power supply circuit. The sixth power supply circuit 26 is a power supply circuit of special specifications. For example, the sixth power supply circuit 26 is used for the highest driving voltage rank, is used as a VCOM power supply voltage for the driving elements 11*b*, is used for the driving element(s) 11*b* with which ink is ejected least easily, or is used as an HVDD (high-side back gate voltage) of a p-type MOS (PMOS) transistor 31.

The HVDD voltage is connected to the sixth power supply circuit 26 having a higher output voltage than the first to fifth power supply circuits 21 to 25. With this configuration, flowing of current to a parasitic diode of the PMOS transistor 31 on the high side is successfully prevented even if a voltage higher than that at a source terminal 31*a* of the PMOS transistor 31 is applied to a drain terminal 31*b* of the PMOS transistor 31.

As illustrated in FIG. 6, the printing apparatus 1 includes a plurality of CMOS circuits 30 each for driving a corresponding one of the plurality of driving elements 11*b*. The FPGA 72*a* outputs a gate signal to the CMOS circuit 30 via a first control line 33(1) to an n-th control line 33(*n*) (where n is a natural number greater than or equal to 2). Note that the first to nth control lines 33(1) to 33(*n*) correspond to the first to n-th power supply lines 34(1) to 34(*n*), respectively. That is, the first control line 33(1) corresponds to the first power supply line 34(1), and the n-the control line 33(*n*) corresponds to the n-th power line 34(*n*).

The FPGA 72*a* outputs, to the switching circuit 27, a signal for connecting each of the first to n-th power supply lines 34(*a*) to 34(*n*) to any one of the first to sixth power supply circuits 21 to 26. The FPGA 72*a* accesses the non-volatile memory 11*e* when necessary. The non-volatile memory 11*e* stores a plurality of nozzle addresses for identifying the individual driving elements 11*b* and ranks associated with the respective nozzle addresses. The ranks will be described later.

As illustrated in FIG. 6, the CMOS circuit 30 includes the PMOS transistor 31, an N-type MOS (NMOS) transistor 32, a resistor 35, and the two piezoelectric bodies 11*b*1 and 11*b*2. The piezoelectric bodies 11*b*1 and 11*b*2 function as capacitors. Note that the driving element 11*b* may include only a single piezoelectric body instead of the two piezoelectric bodies 11*b*1 and 11*b*2. The source terminal 31*a* of the PMOS transistor 31 is connected to any of the first to n-th power supply lines 34(1) to 34(*n*). A source terminal 32*a* of the NMOS transistor 32 is connected to the ground.

The drain terminal 31*b* of the PMOS transistor 31 and a drain terminal 32*b* of the NMOS transistor 32 are connected to one end of the resistor 35. The other end of the resistor 35 is connected to the other end of the piezoelectric body 11*b*1 and one end of the piezoelectric body 11*b*2. The one end of the piezoelectric body 11*b*1 is connected to VCOM voltage, that is, the sixth power supply voltage, and the other end of the piezoelectric body 11*b*2 is connected to the ground.

A gate terminal 31*c* of the PMOS transistor 31 and a gate terminal 32*c* of the NMOS transistor 32 are connected to any of the first to n-th control lines 33(1) to 33(*n*). Note that the first to n-th control lines 33(1) to 33(*n*) correspond to the first to n-th power supply lines 34(1) to 34(*n*) connected to the source terminal 31*a* of the PMOS transistor 31, respectively.

When a low-level ("L") output signal is input from the FPGA 72*a* to the gate terminal 31*c* of the PMOS transistor 31 and the gate terminal 32*c* of the NMOS transistor 32, the PMOS transistor 31 conducts. At that time, the piezoelectric body 11*b*2 is charged, and the piezoelectric body 11*b*1 is discharged. When a high-level ("H") output signal is input from the FPGA 72*a* to the gate terminal 31*c* of the PMOS transistor 31 an the gate terminal 32*c* of the NMOS transistor 32, the NMOS transistor 32 conducts. At that time, the piezoelectric body 11*b*2 is discharged, and the piezoelectric body 11*b*1 is charged. The piezoelectric bodies 11*b*1 and 11*b*2 deform as a result of being charged and discharged and cause ink to be ejected from the nozzle 11*a*.

Ranks assigned to the nozzles 11*a* will be described. Note that the nozzles 11*a* and the driving elements 11*b* have a one-to-one correspondence. A relationship between a nozzle address for identifying each of the nozzles 11*a* and a speed of a liquid droplet (ink) ejected from the nozzle 11*a* corresponding to the nozzle address is illustrated as a graph of FIG. 7, for example. Note that the speed of a liquid droplet (liquid droplet speed) is the speed of a liquid droplet ejected from each of the nozzles 11*a* when a constant voltage is applied to the corresponding driving element 11*b*. For example, if a single head unit 11 includes 1680 nozzles 11*a*, the non-volatile memory 11*e* stores 1680 nozzle addresses.

Figure 7:
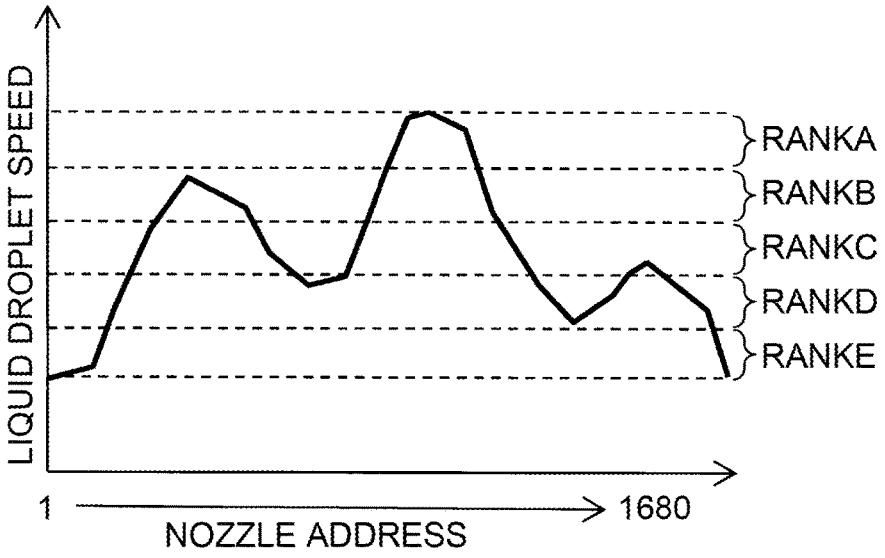
FIG. 7 is a graph illustrating a relationship between a nozzle address for identifying a corresponding nozzle and a speed of a liquid droplet (ink) ejected from the nozzle corresponding to the nozzle address in response to application of a constant voltage to piezoelectric bodies.

As illustrated in FIG. 7, for example, the liquid droplet speed is categorized into five speed ranges, and the speed ranges are each associated with one of ranks A to E. The rank A corresponds to a speed range for the highest liquid droplet speed, and the rank E corresponds to a speed range for the lowest liquid droplet speed. According to the liquid droplet speed of each of the nozzles 11*a*, one of the ranks A to E is stored in the non-volatile memory 11*e* in association with the corresponding nozzle address. Although the liquid droplet speed is used as an example herein, the same idea can be usable for an amount of ejected liquid droplet.

Ink is most easily ejected from the nozzles 11*a* (with the driving elements 11*b*) associated with the rank A, and ink is least easily ejected from the nozzles 11*a* (with the driving elements 11*b*) associated with the rank E. Thus, in order to make the liquid droplet speed or the amount of ejected liquid droplet of the individual nozzles 11*a* uniform, the lowest voltage is applied to the driving elements 11*b* associated with the rank A and the highest voltage is applied to the driving elements 11*b* associated with the rank E.

A first table (see FIG. 8) and a second table (see FIG. 9) are stored in the non-volatile memory 11*e*.

FIG. 8 is a diagram for describing the first table stored in the non-volatile memory 11*e*. Referring to FIG. 8, a nozzle address field represents a nozzle address of each of the nozzles 11*a* (driving element 11*b*). A rank field represents one of the ranks A to E associated with the nozzle 11*a*. A driving voltage field represents a voltage according to the rank and used to drive the driving element 11*b*. The relationship illustrated in FIG. 7 corresponds to a relationship between each nozzle address and the corresponding rank assigned to the nozzle address stored in the first table.

FIG. 9 is a diagram for describing the second table stored in the non-volatile memory 11*e*. Referring to FIG. 9, a number-of-nozzles field represents the number of nozzles 11*a* (driving elements 11*b*) associated with each rank. A power-supply-number field represents the number of the power supply circuit assigned to each rank. A rank field and a driving voltage field are substantially the same as those of FIG. 8.

The driving voltage is a voltage used to drive the driving element 11*b* corresponding to a certain nozzle 11*a* in order to eject ink from the nozzle 11*a* at a target liquid droplet speed. Each driving voltage is stored in the non-volatile memory 11*e* in association with the corresponding rank in order to reduce a difference in the liquid droplet speed among the plurality of nozzles 11*a*. Note that the power supply numbers 1 to 6 correspond to the first to sixth power supply circuits 21 to 26, respectively.

The number of nozzles associated with each of the ranks A to E is calculated in advance. The calculated numbers of nozzles are stored in the second table in the non-volatile memory 11*e*. For example, as illustrated in FIG. 9, the numbers of nozzles for the ranks A, B, C, D, and E are 10, 350, 800, 500, and 20, respectively.

The power supply number 6 is assigned to the rank E associated with the highest driving voltage (27.6 V). In addition, each of the first to fifth power supply circuits 21 to 25 (power supply numbers 1 to 5) is assigned to a corresponding one of the ranks A to D in descending order of the number of nozzles. The assigned power supply numbers are stored in the second table. For example, as illustrated in FIG.

9, the power supply number 4 is assigned to the rank A (24.4 V), the power supply number 3 is assigned to the rank B (25.2 V), the power supply numbers 1 and 5 are assigned to the rank C (26.0 V), and the power supply number 2 is assigned to the rank D (26.8 V). Since the number of nozzles for the rank C is the largest, two power supply numbers, i.e., the power supply numbers 1 and 5, are assigned thereto. Voltages that are substantially equal to the driving voltages corresponding to the power supply numbers 1 to 6 are the output voltages of the first to sixth power supply circuits 21 to 26, respectively.

A power supply connection process will be described with reference to FIG. 10. Each of the FPGAs 72*a* performs the power supply connection process before the printing apparatus 1 starts printing. Note that the non-volatile memory 11*e* has a storage area for storing a variable k and temperature T(k) (described later). After the startup of the printing apparatus 1, each of the FPGAs 72*a* starts the power supply connection process. First, the FPGA 72*a* refers to the first and second tables (step S1). Then, in accordance with correspondences between a nozzle address and a power supply number, which are stored in the first and second tables, the FPGA 72*a* causes the driving element 11*b* indicated by each nozzle address to be connected to one of the power supply circuits 21 to 26 (step S2). For example, since the nozzle address 1 is associated with the rank E and the rank E is associated with the power supply number 6, the FPGA 72*a* causes the driving element 11*b* indicated by the nozzle address 1 to be connected to the sixth power supply circuit 26. In addition, since the nozzle address 500 is associated with the rank C and the rank C is associated with the power supply numbers 1 and 5, the FPGA 72*a* causes the driving element 11*b* indicated by the nozzle address 500 to be connected to one of the first power supply circuit 21 and the fifth power supply circuit 25.

Then, the FPGA 72*a* sets the variable k to 1 (step S3) and detects temperature of the ink through the temperature sensor 11*g* (step S4). Then, the FPGA 72*a* stores the detected temperature as the variable T(k), that is, the variable T(1), in the non-volatile memory 11*e* (step S5) and ends the power supply connection process.

Figure 11:
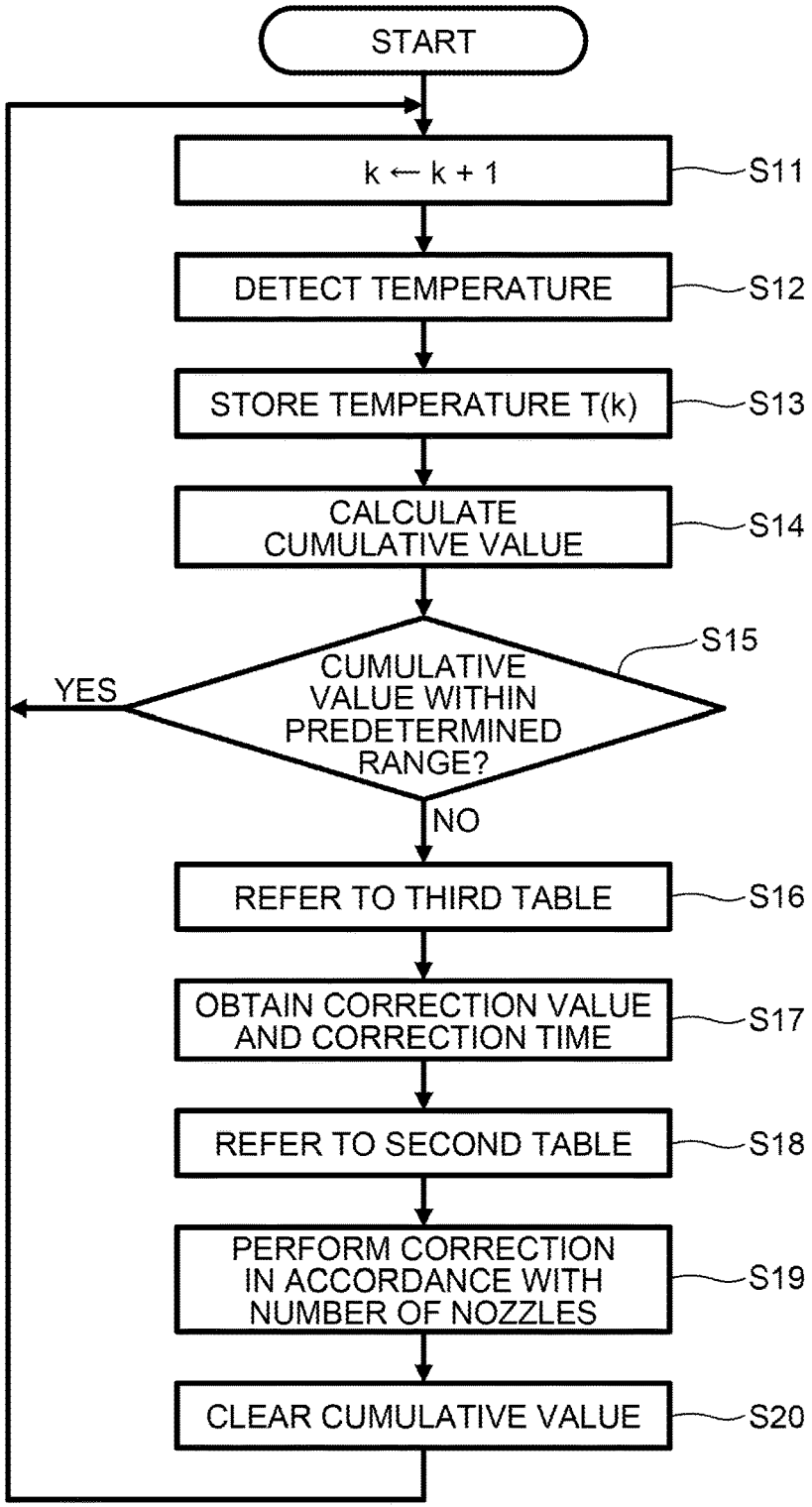
FIG. 11 is a flowchart for describing a voltage correction process performed after printing is started.

A voltage correction process will be described next with reference to FIG. 11. Each of the FPGAs 72*a* performs the voltage correction process after the printing apparatus 1 has started printing. Note that the non-volatile memory 11*e* stores a third table indicating a temperature change, a correction value, and a correction time (see FIG. 12).

A cumulative value field of the third table represents a positive or negative cumulative value of "T(k)−T(k−1)". In addition, a correction value field represents a positive or negative voltage value [V] to be added (for correction). A correction time field represents time [s] to be taken for correction. For example, in the case where the cumulative value is greater than or equal to 0.1 and is less than 0.2, the correction value is 0.05 [V] and the correction time is 0.01 [s]. In addition, for example, in the case where the cumulative value is greater than or equal to −0.2 and is less than −0.1, the correction value is −0.05 [V] and the correction time is 0.01 [s].

After finishing the power supply connection process, the FPGA 72*a* starts printing and performs the voltage correction process. Note that a predetermined range (described later) is stored in the non-volatile memory 11*e* in advance.

The FPGA 72*a* increments the variable k by one (step S11) and detects the temperature of the ink through the temperature sensor 11*g* (step S12). Then, the FPGA 72*a* stores the detected temperature as the variable T(k) (step S13).

The FPGA 72*a* calculates a cumulative value of differences between T(k) and T(k−1). For example, the FPGA 72*a* prepares a storage area for calculating the cumulative value in advance and adds the difference to the value stored in this storage area. Note that the value initially stored in the storage area is 0. Then, the FPGA 72*a* determines whether the cumulative value is within the predetermined range (step S15).

If the FPGA 72*a* determines that the cumulative value is within the predetermined range (YES in step S15), the process returns to step S11. When the cumulative value is within the predetermined range, there is little change in temperature of the ink. Therefore, there is no need to correct the voltages to be applied to the driving elements 11*b* in accordance with the temperature change of the ink. The predetermined range is not limited to a particular range. The predetermined range may be, for example, greater than or equal to −0.1 [° C.] and is less than 0.1 [° C.]. The cumulative value is a value to be compared with the predetermined range to determine the necessity of correction of the voltages to be applied to the driving elements 11*b*.

If the FPGA 72*a* determines that the cumulative value is not within the predetermined range (NO in step S15), the FPGA 72*a* refers to the third table (step S16) and obtains the correction value and the correction time that are associated with the cumulative value that is not within the predetermined range and is a positive or negative value (step S17).

Then, the FPGA 72*a* refers to the second table (step S18) and corrects the voltages to be applied to the driving elements 11*b* in accordance with the number of nozzles (step S19). Then, the FPGA 72*a* clears the cumulative value to the initial value of 0 (step S20).

Now, an example will be described where T(1)=20.00° C., T(2)=20.06° C., T(3)=20.14° C., and the predetermined range is greater than or equal to −0.1 [° C.] and is less than +0.1 [° C.]. In this example case, since T(2)−T(1)=0.06, the cumulative value is equal to 0 (initial value)+0.06=0.06, which is less than 0.1. Thus, the FPGA 72*a* does not correct the voltages to be applied to the driving elements 11*b* when T(2)−T(1) is calculated (YES in step S15).

On the other hand, since T(3)−T(2)=0.08, the cumulative value is equal to 0+0.06+0.08=0.14, which is greater than or equal to 0.1. Thus, the FPGA 72*a* corrects the voltages to be applied to the driving elements 11*b* when T(3)−T(2) is calculated (NO in step S15 and S16 to S19).

For example, the FPGA 72*a* corrects the output voltages of the first to sixth power supply circuits 21 to 26 in descending order of the number of nozzles. When the ranks A to E are re-arranged in descending order of the number of nozzles illustrated in the second table, the result is C, D, B, E, and A (see FIG. 9). The power supply numbers associated with the respective ranks are 1 and 5, 2, 3, 6, and 4. That is, the FPGA 72*a* first corrects the output voltages of the first power supply circuit 21 and the fifth power supply circuit 25. Then, the FPGA 72*a* corrects the output voltage in the order of the second power supply circuit 22, the third power supply circuit 23, and the sixth power supply circuit 26. Lastly, the FPGA 72*a* corrects the output voltage of the fourth power supply circuit 24. As for the correction order of the first power supply circuit 21 and the fifth power supply circuit 25, either can be done first. That is, in the case where a plurality of power supply circuits are associated with a single rank, the correction order for the power supply circuits is not limited to a particular order.

In the case where the cumulative value of the differences between T(k) and T(k−1) is greater than or equal to P1 and is less than P2, the output voltage of the first power supply circuit 21 is corrected in the following manner. Since the output voltage of the first power supply circuit 21 is 26.0 the target value of the output voltage after the correction is 26.0+α1 [V]. The FPGA 72*a* changes the output voltage of the first power supply circuit 21 incrementally so that the output voltage (26.0 [V]) of the first power supply circuit 21 changes to 26.0+α1 [V] after the correction time β1 passes from the start of the correction (see FIG. 12). That is, the FPGA 72*a* changes the output voltage of the first power supply circuit 21 by using a smaller correction value than α1 at a certain time point before the correction time β1 passes from the start of the correction. In other words, the output voltage of the first power supply circuit 21 is between 26.0 [V] and 26.0+α1 [V] at the certain time point before the correction time β1 passes from the start of the correction. Thereafter, the FPGA 72*a* changes the output voltage of the first power supply circuit 21 by using the correction value al after the correction time β1 passes from the start of the correction. That is, the output voltage of the first power supply circuit 21 is 26.0+α1 [V] after the correction time β1 passes from the start of the correction. The FPGA 72*a* similarly corrects the output voltages of the second to sixth power supply circuits 22 to 26.

As a result of the voltage to be applied to the driving elements 11*b* being corrected incrementally, the amount of ink ejected with the driving elements 11*b* is changed gradually. Consequently, a boundary between a portion printed before the correction and a portion printed after the correction is less distinctly seen in the printed image and the influence of the correction on the image quality is successfully reduced.

Note that the third table is configured such that the correction time increases as the absolute value of the cumulative value of the differences between T(k) and T(k−1) increases. The expression "the correction time increases" equates with "through more steps". As the temperature change increases, the change in the amount of ink ejected with the driving element 11*b* also increases. If the amount of ink ejected with the driving element 11*b* is changed greatly in a short time, the boundary between a portion printed before the change and a portion printed after the change is more distinctly seen.

As the absolute value of the cumulative value of the differences increases, the FPGA 72*a* changes the voltages to be applied to the driving elements 11*b* in a longer time, in other words, through more steps. Consequently, the amount of ink ejected with the driving element 11*b* is gradually changed and the influence of the correction on the image quality is successfully minimized. That is, since the amount of ejected ink is gradually changed in a long time, a difference in the amount of ink ejected before and after the change decreases and consequently occurrence of a boundary in the formed image is successfully suppressed. On the other hand, when the absolute value of the cumulative value of the differences is small, the voltages to be applied to the driving elements 11*b* are changed in a short time. Thus, correction is successfully performed efficiently.

Note that the first to sixth power supply circuits 21 to 26 are merely examples of signal supplies that supply signals for ejecting liquid to the driving elements 11*b*. Further, voltages that are applied to the driving elements 11*b* from the first to sixth power supply circuits 21 to 26, that is, peak values of the voltage signals (pulses), are merely examples of signals for ejecting liquid. That is, other signal supplies that supply signals having pulse widths or pulse rising time points may be used in place of the first to sixth power supply circuits 21 to 26.

In the first embodiment, each of the FPGAs 72*a* connects each driving element 11*b* to any one of the signal supplies, for example, any one of the first to sixth power supply circuits 21 to 26. Further, each of the FPGAs 72*a* corrects, for each of the first to sixth power supply circuits 21 to 26, a signal (for example, voltage) that is applied to the corresponding driving elements 11*b* and that causes ejection of liquid, on the basis of the temperature of the ink in a certain order. Thus, a circumstance where the voltages are collectively corrected in the same time for all the driving elements 11*b* is successfully avoided. As a result, a boundary caused on a printed material before and after the correction is successfully avoided. In addition, since the voltages are corrected on the basis of the temperature of the ink, correction is performed in accordance with a change in viscosity of the ink and consequently the image quality of the printed material is successfully increased.

In addition, the FPGA 72*a* changes the order in which the output voltages of the first to sixth power supply circuits 21 to 26 are corrected in accordance with the number of driving elements 11*b* to which the output voltage of each of the first to sixth power supply circuits 21 to 26 is applied. In this way, correction can be performed efficiently in a short time.

In addition, the FPGA 72*a* preferentially corrects the output voltage of a power supply circuit associated with more driving elements 11*b* among the first to sixth power supply circuits 21 to 26 earlier than those associated with less driving elements 11*b* among the first to sixth power supply circuits 21 to 26. With this configuration, a larger number of driving elements 11*b* are adapted to a change in viscosity of liquid earlier. As a result of early adaptation, a degradation of the image quality of printed materials due to a change in viscosity can be suppressed at an early stage.

If each of the FPGAs 72*a* connects each of the driving elements 11*b* to one of the first to sixth power supply circuits 21 to 26 after printing is started, the processing has to wait until connections between the first to sixth power supply circuits 21 to 26 and the driving elements 11*b* are finished. Thus, the productivity of printed materials decreases. In the first embodiment, each of the FPGAs 72*a* connects each of the driving elements 11*b* to one of the first to sixth power supply circuits 21 to 26 before printing is started. With this configuration, a reduction in the productivity of printed materials is successfully suppressed compared with the case where the first to sixth power supply circuits 21 to 26 and the driving elements 11*b* are connected after printing is started. In addition, since each of the FPGAs 72*a* corrects the output voltages of the first to sixth power supply circuits 21 to 26 on the basis of the temperature of the liquid after printing is started, correction can be performed in accordance with a change in viscosity of the liquid that occurs during the printing.

In addition, the plurality of driving elements 11*b* have different ejection characteristics. However, by applying a voltage (output voltage of one of the first to sixth power supply circuits 21 to 26) according to the ejection characteristic to each of the driving elements 11*b*, a desired amount of ink is successfully ejected with each of the driving elements 11*b*.

In addition, temperatures of the ink detected by the temperature sensor 11*g* are stored in the non-volatile memory 11*e* over time in steps S4, S5, and S11 to S14. Then, each of the FPGAs 72*a* adjusts the time to be taken to achieve the target voltage on the basis of a difference between the latest ink temperature stored in the non-volatile memory 11*e* and the temperature of the ink detected by the temperature sensor 11*g* (temperature of the ink at the time of calculation). Thus, the amount of ink ejected with each of the driving elements 11*b* can be changed appropriately in accordance with the degree of temperature change.

Second Embodiment

A second embodiment of the disclosure will be described below with reference to the accompanying drawing regarding a printing apparatus 1 according to the second embodiment. The printing apparatus 1 according to the second embodiment differs from that of the first embodiment in processing of steps S21 to S23 (described later). In steps S21 to S23, each of the FPGAs 72*a* preferentially corrects voltages associated with more nozzles earlier than voltages associated with less nozzles. The printing apparatus 1 according to the second embodiment performs the power supply connection process before printing is started as in the first embodiment (see FIG. 10).

Figure 13:
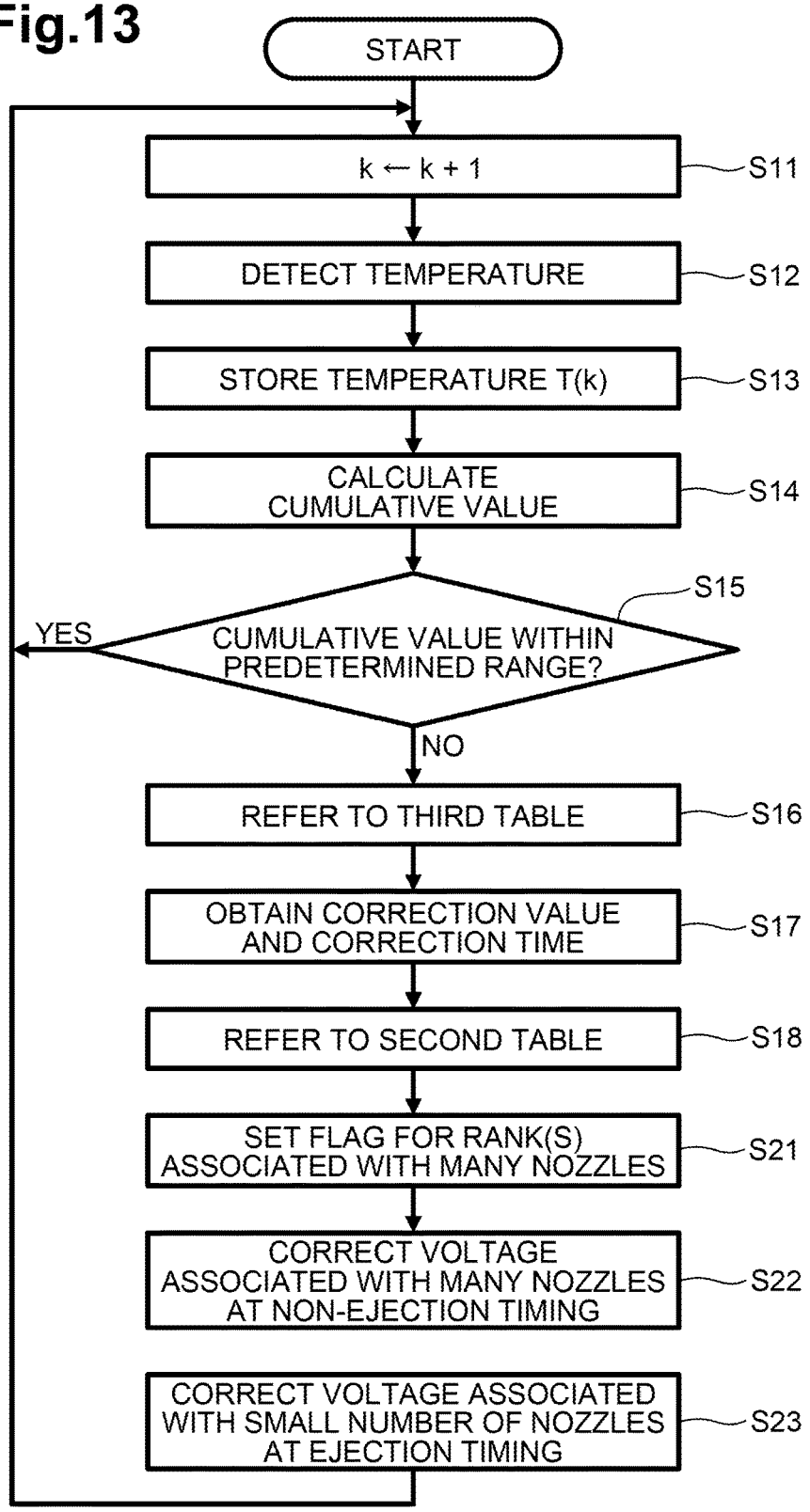
FIG. 13 is a flowchart for describing a voltage correction process performed in a printing apparatus according to a second embodiment after printing is started.

A voltage correction process will be described with reference to FIG. 13. Each of the FPGAs 72*a* performs the voltage correction process after the printing apparatus 1 has started printing. Since processing of steps S11 to S18 illustrated in FIG. 13 is substantially the same as the processing of steps S11 to S18 illustrated in FIG. 11, a detailed description thereof is omitted.

The FPGA 72*a* that has referred to the second table in step S18 sets a flag for rank(s) for which the voltage is applied to many nozzles 11*a* (step S21).

In step S21, the FPGA 72*a* sets a flag for rank(s) associated with the number of nozzles that is greater than or equal to a predetermined threshold, for example. In this case, the predetermined threshold is stored in the non-volatile memory 11*e* in advance.

In the case where the predetermined threshold is equal to 300, the FPGA 72*a* that has referred to the second table sets a flag for the ranks B, C, and D. No flag is set for rank(s) associated with the number of nozzles that is less than the threshold. In other words, the ranks for which no flag is set are ranks for which the voltage is applied to a small number of nozzles 11*a*.

Note that a method for determining whether the number of nozzle is large is not limited to the method described above. For example, a flag may be set for three power supply circuits associated with the first to third largest numbers of nozzles by comparing the numbers of nozzles associated with the six power supply circuits.

With reference to print data transmitted from the external apparatus 9, the FPGA 72*a* determines a timing at which liquid need not be ejected, for example, a timing corresponding to a margin or an interval of printing. At the determined timing, the FPGA 72*a* corrects the output voltage of the power supply circuit(s) for which the flag has been set, that is, the power supply circuit(s) associated with many nozzles 11*a* (step S22).

In the case where the flag is set for the ranks B, C, and D, the FPGA 72*a* corrects output voltages of the third power supply circuit 23 associated with the rank B, the first power supply circuit 21 and the fifth power supply circuit 25 associated with the rank C, and the second power supply circuit 22 associated with the rank D in descending order of the number of nozzles. Specifically, the FPGA 72*a* corrects the output voltage of the first power supply circuit 21 and the fifth power supply circuit 25 first. Then, the FPGA 72*a* corrects the output voltage of the second power supply circuit 22. Lastly, the FPGA 72*a* corrects the output voltage of the third power supply circuit 23.

Then, with reference to the print data transmitted from the external apparatus 9, the FPGA 72*a* determines a timing at which liquid is ejected. At the determined timing, the FPGA 72*a* corrects the output voltage of the power supply circuit(s) for which the flag has not been set, that is, the power supply circuit(s) associated with a small number of nozzles 11*a* (step S23). After the processing of step S23, the process returns to step S11.

In the case where the flag has not been set for the ranks A and E, the FPGA 72*a* corrects the output voltages of the fourth power supply circuit 24 associated with the rank A and the sixth power supply circuit 26 associated with the rank E in descending order of the number of nozzles. Specifically, the FPGA 72*a* corrects the output voltage of the sixth power supply circuit 26 first. The FPGA 72*a* then corrects the output voltage of the fourth power supply circuit 24.

As in the first embodiment, the FPGA 72*a* corrects the output voltages of the first to sixth power supply circuits 21 to 26 by changing the output voltages incrementally so that the corrected output voltage reaches the target value after the correction time passes (see FIG. 12).

In step S22, the FPGA 72*a* corrects the output voltages of the first to third and fifth power supply circuits 21 to 23 and 25 associated with many nozzles 11*a* (in other words, many driving elements 11*b*) at a timing at which liquid need not be ejected, for example, a timing corresponding to a margin or an interval of printing. That is, since the FPGA 72*a* performs the correction when a printing operation is temporarily suspended after printing has been started, an amount of ejected liquid is not changed while an image is being formed on a sheet. Thus, the image quality of the printed material is more likely to be maintained.

In addition, since the amount of liquid ejected using many driving elements 11*b* are corrected at a timing at which the liquid is not ejected, the influence of the correction on the image quality of the printed material can be effectively reduced.

In step S23, the FPGA 72*a* corrects the output voltages of the fourth and sixth power supply circuits 24 and 26 associated with a small number of nozzles 11*a* at a timing at which liquid is ejected. Even if a signal supplied to a small number of nozzles 11*a* (in other words, a small number of driving elements 11*b*) is corrected at a timing at which liquid is ejected, a boundary is hardly caused in an image before and after the correction and the influence on the image quality is small. Thus, for example, the FPGA 72*a* corrects signals supplied to many driving elements 11*b* at a timing at which liquid is not ejected and corrects signals supplied to a small number of driving elements 11*b* at a timing at which liquid is ejected. In this way, the time in which the FPGA 72*a* corrects the signals supplied to the small number of driving elements 11*b* can be made different from the time in which the FPGA 72*a* corrects the signals supplied to many driving elements 11*b*. Thus, the times of the correction performed by the FPGA 72*a* can be split, and consequently the load of the FPGA 72*a* can be reduced.

Note that the FPGA 72*a* may correct the output voltages of the fourth and sixth power supply circuits 24 and 26 associated with a small number of nozzles 11*a* in a time other than the timing at which liquid is ejected. That is, the FPGA 72*a* may perform the correction in a given time. Even if the voltage supplied to a small number of nozzles 11*a* (a small number of driving elements 11*b*) is corrected in a time other than the timing at which liquid is not ejected, the influence of the correction on the image quality is small. That is, as a result of the FPGA 72*a* performing the correction in a given time including a timing at which liquid is ejected without limiting the correction timing of the voltages supplied to a small number of driving elements 11*b* to a timing at which liquid need not be ejected, a reduction in the productivity can be suppressed.

Components relating to the second embodiment that are the same or substantially the same as those of the first embodiment are denoted by the same reference signs, and a detailed description thereof is omitted.

Third Embodiment

Figure 14:
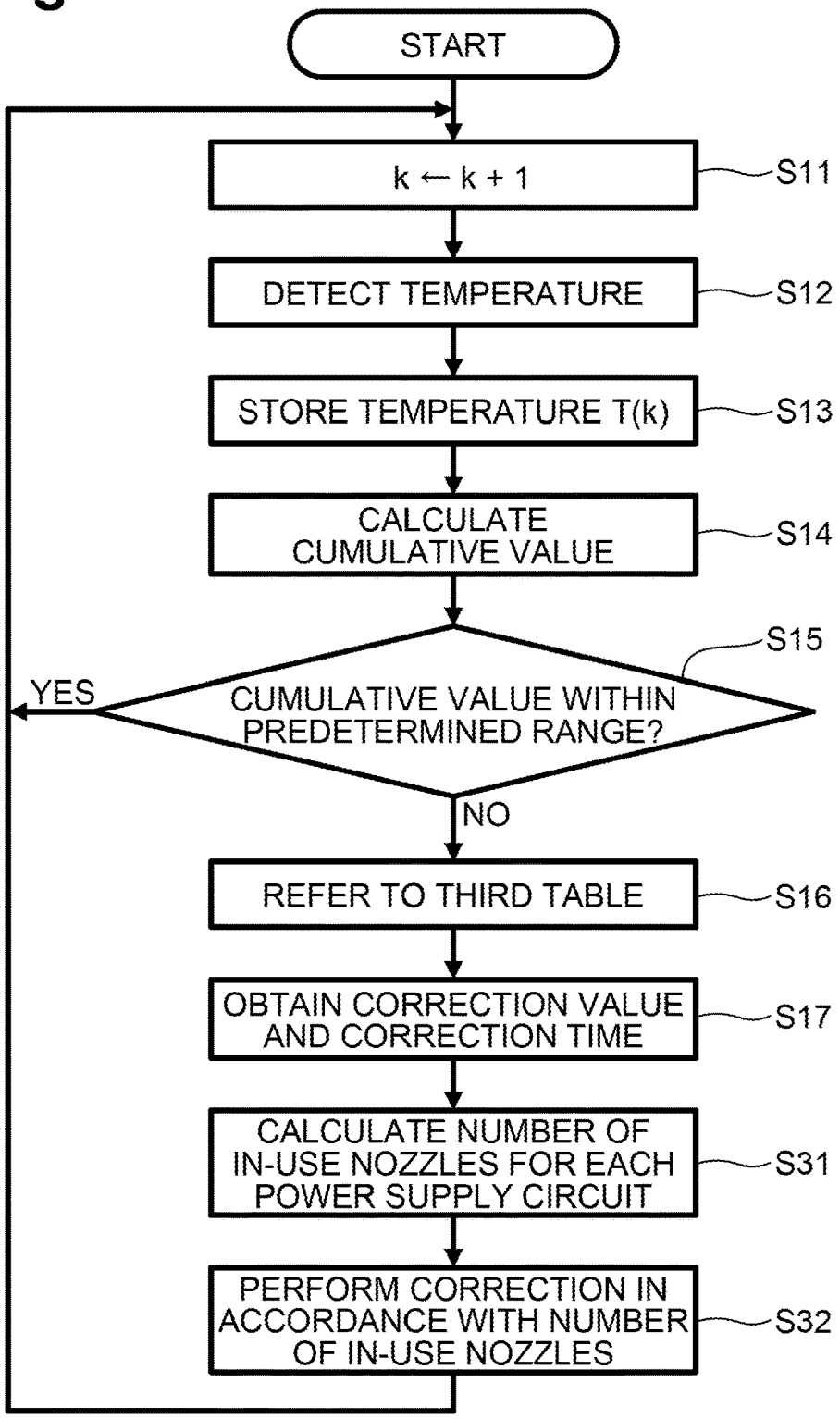
FIG. 14 is a flowchart for describing a voltage correction process performed in a printing apparatus according to a third embodiment after printing is started.

A third embodiment of the disclosure will be described below with reference to the accompanying drawings regarding a printing apparatus 1 according to the third embodiment. The printing apparatus 1 according to the third embodiment differs from that of the first embodiment in processing of steps S31 and S32 (described later). In steps S31 and S32, each of the FPGAs 72*a* preferentially corrects the voltage associated with a large number of in-use nozzles earlier than the voltage associated with a small number of in-use nozzles. A voltage correction process performed by the FPGA 72*a* after printing has been started will be described (see FIG. 14). Note that since processing of steps S11 to S17 illustrated in FIG. 14 is the same or substantially the same as the processing of steps S11 to S17 illustrated in FIG. 11, a detailed description of thereof is omitted.

The FPGA 72*a* that has obtained the correction value and the correction time associated with the cumulative value of the differences between T(k) and T(k−1) in step S17 calculates, for each of the first to sixth power supply circuits 21 to 26, the number of nozzles that are in-use (the number of in-use nozzles) (step S31).

For example, the number of nozzles associated with the second power supply circuit 22 is 500 (see FIG. 9). If the number of nozzles 11*a* in use is 300 among the 500 nozzles, then the number of in-use nozzles of the second power supply circuit 22 is 300. Note that the FPGA 72*a* determines, for each of the first to sixth power supply circuits 21 to 26, whether each of the nozzles 11*a* is to be used on the basis of print data transmitted from the external apparatus 9.

The FPGA 72*a* corrects the voltages to be applied to the driving elements 11*b* in accordance with the number of in-use nozzles (step S32).

For example, the FPGA 72*a* corrects output voltages of the first to sixth power supply circuits 21 to 26 in descending order of the number of in-use nozzles. As illustrated in a fourth table in FIG. 15, the case is discussed where the first power supply circuit 21 is associated with 800 nozzles and with 400 in-use nozzles, the second power supply circuit 22 is associated with 500 nozzles and with 250 in-use nozzles, the third power supply circuit 23 is associated with 350 nozzles and with 300 in-use nozzles, the fourth power supply circuit 24 is associated with 10 nozzles and with 0 in-use nozzles, the fifth power supply circuit 25 is associated with 800 nozzles and with 450 in-use nozzles, and the sixth power supply circuit 26 is associated with 20 nozzles and with 5 in-use nozzles. In this case, the power supply circuits are arranged in descending order of the number of in-use nozzles such that the fifth power supply circuit 25, the first power supply circuit 21, the third power supply circuit 23, the second power supply circuit 22, the sixth power supply circuit 26, and the fourth power supply circuit 24. Note that the fourth table is created through the calculation in step S31.

Specifically, the FPGA 72*a* corrects the output voltage of the fifth power supply circuit 25 first. Then, the FPGA 72*a* corrects the output voltage in the order of the first power supply circuit 21, the third power supply circuit 23, and the second power supply circuit 22. Lastly, the FPGA 72*a* corrects the output voltage of the sixth power supply circuit 26. The FPGA 72*a* does not correct the output voltage of the fourth power supply circuit 24 because the number of in-use nozzles associated with the fourth power supply circuit 24 is 0, that is, no nozzles 11*a* are used.

The number of nozzles (350) associated with the third power supply circuit 23 is less than the number of nozzles (500) associated with the second power supply circuit 22 (see FIG. 9). On the other hand, the number of in-use nozzles (300) associated with the third power supply circuit 23 is more than the number of in-use nozzles (250) associated with the second power supply circuit 22 (see FIG. 15). For this reason, the FPGA 72*a* performs correction of the output voltage of the third power supply circuit 23 earlier than correction of the output voltage of the second power supply circuit 22. That is, since the FPGA 72*a* changes the order of correction in accordance with the number of in-use nozzles regardless of the number of nozzles, the FPGA 72*a* can perform appropriate correction based on the usage of the nozzles during printing.

As in the first embodiment, the FPGA 72*a* corrects the output voltages of the first to sixth power supply circuits 21 to 26 by changing the output voltages incrementally so that the corrected output voltage reaches the target value after the correction time passes (see FIG. 12).

In step S32, the FPGA 72*a* calculates, for each of the first to sixth power supply circuits 21 to 26, the number of driving elements 11*b* that are in use on the basis of the input print data. The FPGA 72*a* further changes the order in which the output voltages of the first to sixth power supply circuits 21 to 26 are corrected in accordance with the calculated numbers of in-use driving elements 11*b*. In this way, appropriate correction can be performed in accordance with the usage of the nozzles during printing. In addition, since the FPGA 72*a* performs the correction every time print data is input, correction appropriate for the input print data can be performed regardless of content of the input print data.

In addition, for the fourth power supply circuit 24 for which no nozzles 11*a* are in use, the output voltage to be applied to the driving elements 11*b* is not corrected. Thus, the processing speed of the entire voltage correction process performed by the FPGA 72*a* can be increased.

Components relating to the third embodiment that are the same or substantially the same as those of the first or second embodiment are denoted by the same reference signs, and a detailed description thereof is omitted.

Fourth Embodiment

A fourth embodiment of the disclosure will be described with reference to the accompanying drawing regarding a printing apparatus 1 according to the fourth embodiment. The printing apparatus 1 according to the fourth embodiment differs from that of the first embodiment in processing of step S41 (described later). In step S41, the FPGA 72*a* performs correction according to driving voltage. As in the first embodiment, the printing apparatus 1 according to the fourth embodiment performs the power supply connection process before printing is started (see FIG. 10).

Figure 16:
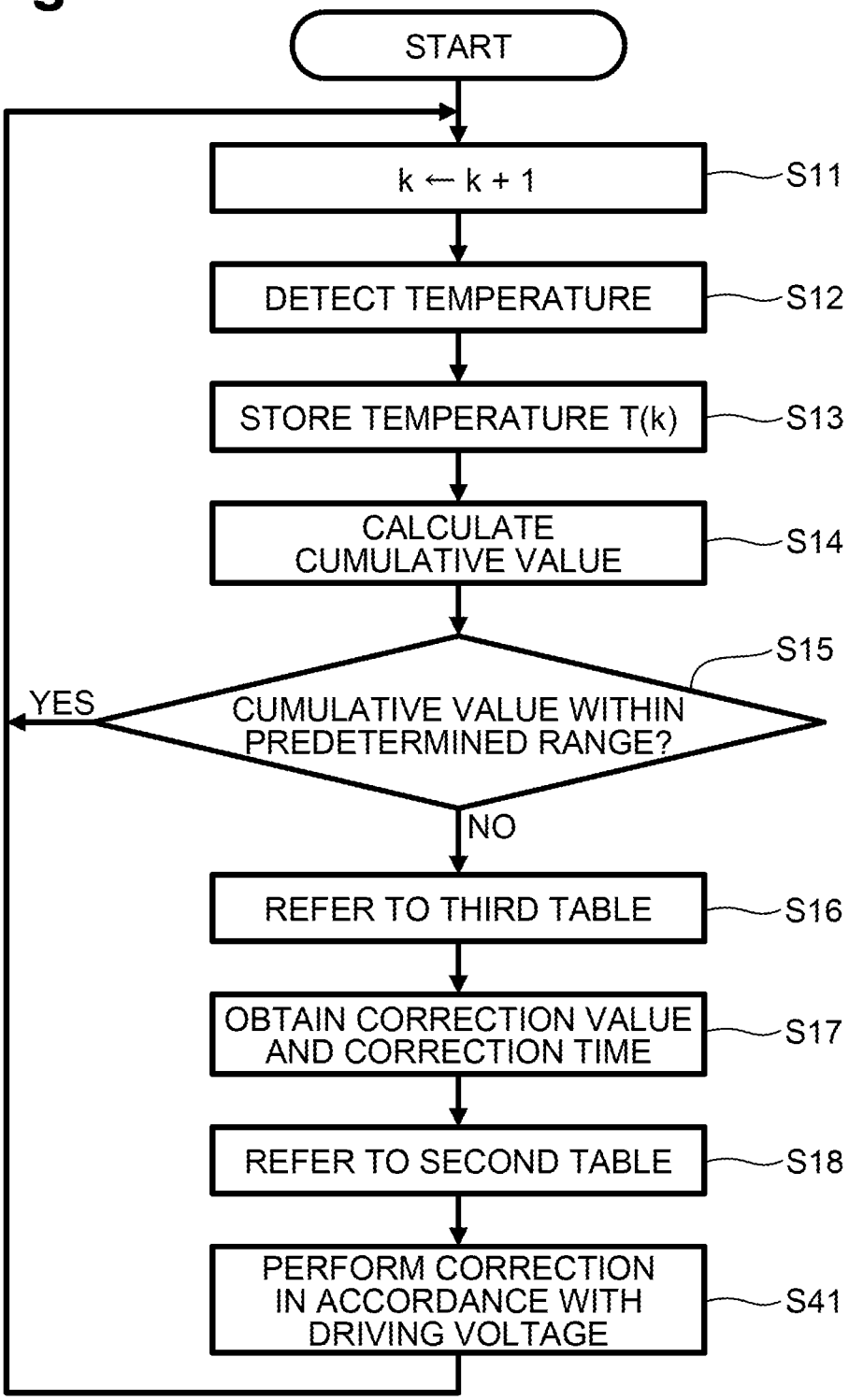
FIG. 16 is a flowchart for describing a voltage correction process performed in a printing apparatus according to a fourth embodiment after printing is started.

A voltage correction process performed by the FPGA 72*a* after the start of printing will be described (see FIG. 16). Note that since processing of steps S11 to S18 illustrated in FIG. 16 is the same or substantially the same as the processing of steps S11 to S18 illustrated in FIG. 11, a detailed description thereof is omitted.

The FPGA 72*a* that has referred to the second table in step S18 performs correction according to the driving voltage for each of the driving elements 11*b* (step S41).

For example, the FPGA 72*a* corrects the output voltage of the power supply circuit corresponding to the median among the plurality of driving voltages first. More specifically, the median is a value that is located at the middle when the plurality of driving voltages are arranged in ascending or descending order. For example, when all the driving voltages of 24.4 [V], 25.2 [V], 26.0 [V], 26.8 [V], and 27.6 [V] in the second table are arranged in descending order, the obtained order is 27.6 [V], 26.8 [V], 26.0 [V], 25.2 [V], and 24.4 [V]. In this case, 26.0 [V] located at the third place among the five driving voltages is the median. Thus, the FPGA 72*a* corrects the output voltage of the first power supply circuit 21 and the fifth power supply circuit 25 that are associated with 26.0 [V] first.

Then, the FPGA 72*a* corrects the output voltage of the power supply circuit associated with a driving voltage closest to the median. Specifically, the FPGA 72*a* corrects the output voltage of the third power supply circuit 23 associated with 25.2 [V] and the output voltage of the second power supply circuit 22 associated with 26.8 [V].

The order in which the output voltages of the third power supply circuit 23 and the second power supply circuit 22 are corrected is not limited to a particular order. However, it is preferable that the output voltage of the second power supply circuit 22 be corrected earlier than the output voltage of the third power supply circuit 23 because of the following reason.

A change in the amount of ejected ink relative to a correction amount of the voltage becomes sometimes larger when the supplied voltage is higher. The following issue occurs if correction of the output voltage of the second power supply circuit 22 having a higher voltage is performed after correction of the output voltage of the third power supply circuit 23 having a lower voltage. For example, since the amount of ejected ink is not changed regardless of the fact that the amount of ejected ink is supposedly changed by relatively largely in accordance with a change in viscosity of the ink, the degradation of the image quality is likely to occur. Therefore, by performing correction of the output voltage (higher voltage) of the second power supply circuit 22 earlier than correction of the output voltage (lower voltage) of the third power supply circuit 23, a decrease in the image quality due to a change in viscosity of the ink can be quickly avoided.

The FPGA 72*a* then corrects the output voltage of the power supply circuit associated with a driving voltage that is second closest to the median. Specifically, the FPGA 72*a* corrects the output voltage of the fourth power supply circuit 24 associated with 24.4 [V] and the output voltage of the sixth power supply circuit 26 associated with 27.6 [V].

The order in which the output voltages of the fourth power supply circuit 24 and the sixth power supply circuit 26 are corrected is not limited to a particular order. However, it is preferable that the output voltage of the sixth power supply circuit 26 having a higher output voltage be corrected earlier than that of the fourth power supply circuit 24 having a lower output voltage because of the reason described above.

After the FPGA 72*a* has corrected the output voltages of the fourth power supply circuit 24 and the sixth power supply circuit 26, that is, after the FPGA 72*a* has corrected the output voltages of all the first to sixth power supply circuits 21 to 26, the process returns to step S11.

As in the first embodiment, the FPGA 72*a* corrects the output voltages of the first to sixth power supply circuits 21 to 26 by changing the output voltages incrementally so that the corrected output voltage reaches the target value after the correction time passes (see FIG. 12).

In step S41, the FPGA 72*a* corrects voltages to be applied to the respective driving elements 11*b* in accordance with values of the plurality of driving voltages. There is a certain correlation between the value of the driving voltage and the number of driving elements 11*b*. Thus, the FPGA 72*a* corrects the output voltages of the first to sixth power supply circuits 21 to 26 in accordance with the values of the driving voltages. With this configuration, the output voltage of the power supply circuit associated with more driving elements correlated to the driving voltage value among the power supply circuits 21 to 26 can be preferentially corrected earlier. That is, the output voltages of the first to sixth power supply circuits 21 to 26 can be efficiently corrected without referring to the number of driving elements 11*b* associated with the driving voltage or without referring to the print data.

In addition, a voltage having a larger difference from the highest voltage or the lowest voltage, that is, the output voltage of the power supply circuit that is closest to the median of the plurality of driving voltages among the first to sixth power supply circuits 21 to 26, is preferentially corrected earlier. The median is set to a specification voltage of the driving elements 11*b* because the voltages are set in the following manner. The inkjet heads 4 have characteristics in which a distribution of voltages for 1680 nozzles 11*a* is such that the number of voltages tends to decrease as a distance from the center which is a certain voltage range increases. The center voltage is set as the voltage of a power supply circuit having the third highest voltage among the five power supply circuits, for example. Then, voltages that are close to the center voltage and have a high frequency are set as the second highest and fourth highest voltages. The voltages are set in this manner, the largest number of driving elements 11*b* are associated with the output voltages of the power supply circuits that are close to the median among the power supply circuits 21 to 26 and the least number of driving elements 11*b* are associated with the highest voltage or the lowest voltage. Thus, the FPGA 72*a* can preferentially correct the output voltages of power supply circuits associated with many driving elements 11*b* among the first to sixth power supply circuits 21 to 26 earlier by preferentially correcting the output voltages of the power supply circuits that are close to the median among the first to sixth power supply circuits 21 to 26 earlier.

The image quality can be improved more when voltage applied to many driving elements 11*b* is corrected than when voltage applied to a small number of driving elements 11*b* is corrected. The FPGA 72*a* is capable of making corrections for the largest number of driving elements 11*b* by correcting the output voltage of one of the power supply circuits 21 to 26 corresponding to the median earlier, and consequently can improve the image quality quickly and efficiently.

Components relating to the fourth embodiment that are the same or substantially the same as those of the first to third embodiments are denoted by the same reference signs, and a detailed description thereof is omitted.

Fifth Embodiment

Figure 17:
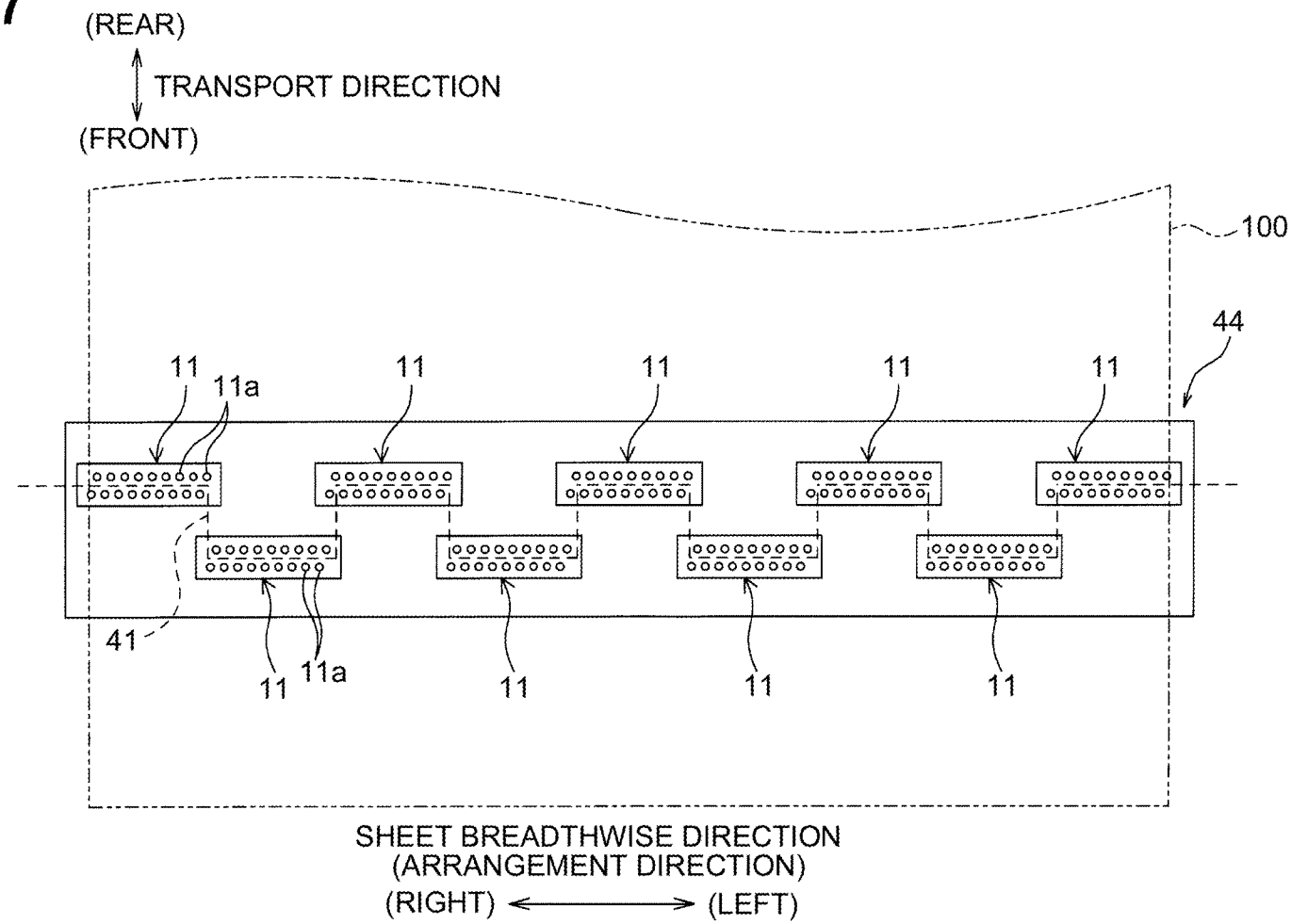
FIG. 17 is a bottom view of an inkjet head of a printing apparatus according to a fifth embodiment.

A fifth embodiment of the disclosure will be described below with reference to the accompanying drawings regarding a printing apparatus 1 according to the fifth embodiment. As illustrated in FIG. 17, a channel 41 that extends in the left-right direction and through which ink flows is provided in an inkjet head 44. Each of the plurality of head units 11 is connected to the channel 41. In other words, the plurality of head units 11 are connected to one another via the channel 41. The ink flows through the channel 41 from the left side to the right side. The printing apparatus 1 according to the fifth embodiment differs from that of the first embodiment in processing of step S51 (described later). In step S51, the FPGA 72*a* corrects the voltage in accordance with the position of each of the head units 11.

Figure 10:
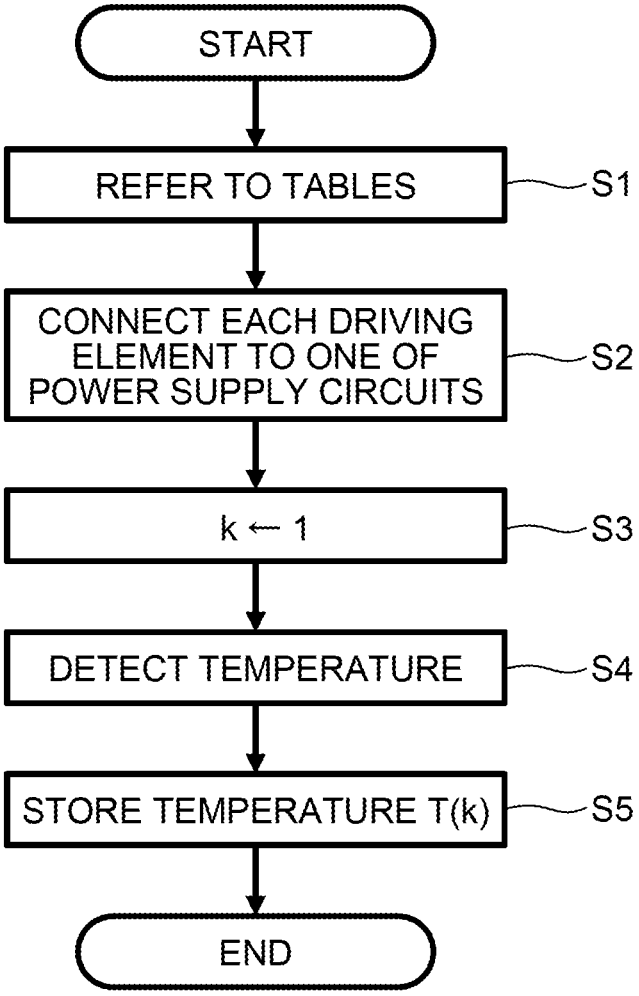
FIG. 10 is a flowchart for describing a power supply connection process performed before printing is started.

As in the first embodiment, the printing apparatus 1 according to the fifth embodiment performs the power supply connection process before printing is started (see FIG. 10). The non-volatile memory 11*e* stores positions of the respective head units 11 in the left-right direction.

Figure 18:
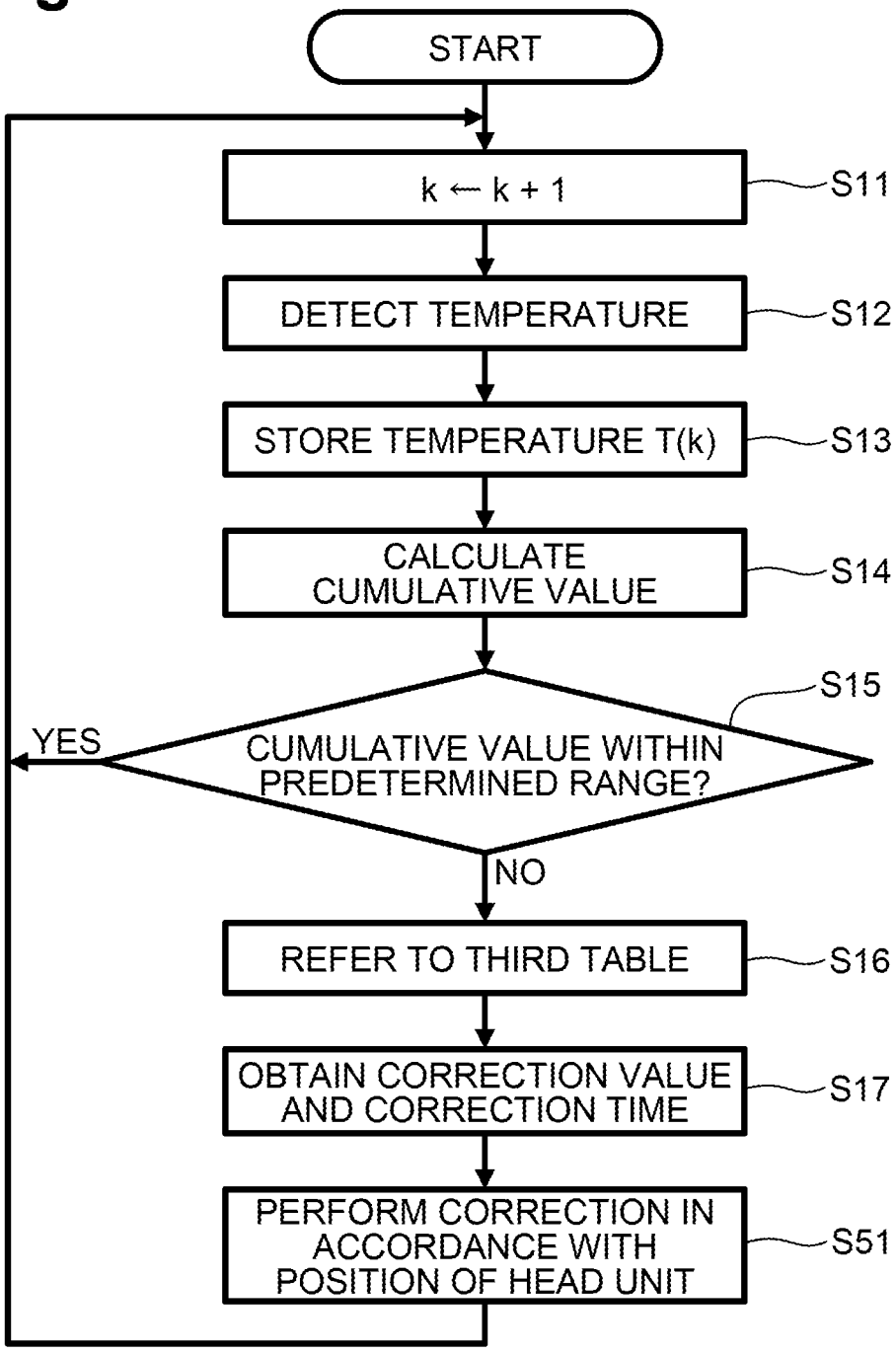
FIG. 18 is a flowchart for describing a voltage correction process performed after printing is started.

A voltage correction process performed by the FPGA 72*a* after the start of printing will be described (see FIG. 18). Since processing of steps S11 to S17 illustrated in FIG. 18 is the same or substantially the same as that of steps S11 to S17 illustrated in FIG. 11, a detailed description thereof is omitted.

The FPGA 72*a* that has obtained the correction value and the correction time in step S17 corrects the output voltage of each of the first to sixth power supply circuits 21 to 26 on the basis of the position of the corresponding head unit 11 in the left-right direction (step S51).

The FPGA 72*a* accesses the non-volatile memory 11*e* and obtains the position of each head unit 11 in the left-right direction. The FPGA 72*a* changes the correction time obtained from the third table on the basis of the position of the head unit 11 in the left-right direction, for example. The correction time is changed in the following manner. If the obtained position in the left-right direction is on the right side (on the downstream side), the correction time is changed to be longer than in the case where the position is on the left side (on the upstream side). That is, the correction time increases as the position of the head unit 11 becomes closer to the downstream end.

As in the first embodiment, the FPGA 72*a* changes the output voltage incrementally so that the corrected output voltage reaches the target value after the correction time passes. In other words, the FPGA 72*a* changes the voltage by an amount of change that is smaller than a difference between the current output voltage and the target value every time a predetermined time passes from the start of the correction before the correction time passes. In this way, the FPGA 72*a* corrects the output voltage of each of the first to sixth power supply circuits 21 to 26 (see FIG. 12).

As the position becomes farther from the ink supply side, the temperature of the ink is affected more by an environmental temperature due to heat generated by the head units 11. Thus, the temperature of the ink supplied to the head units 11 located on the downstream side becomes higher than the temperature of the ink supplied to the head units 11 located on the upstream side. That is, a change in temperature of the ink at the head units 11 located on the downstream side is larger than that on the upstream side. Accordingly, the FPGA 72*a* takes a longer time for correction of the voltage to be applied to the driving elements 11*b* of the head units 11 located on the downstream side than for correction of the voltage to be applied to the driving elements 11*b* of the head units 11 located on the upstream side. With this configuration, the boundary between a portion printed before the correction and a portion printed after the correction becomes less distinctly seen.

Components relating to the fifth embodiment that are the same or substantially the same as those of the first to fourth embodiments are denoted by the same reference signs, and a detailed description thereof is omitted.

The first to sixth power supply circuits 21 to 26 are examples of signal supplies and power supplies. Each of the second control boards 72 is an example of a control board. Each of the FPGAs 72*a* is an example of a control circuit. The non-volatile memory 11*e* is an example of a memory. The number of in-use nozzles is an example of the number of in-use driving elements. The second control boards 72 and the head units 11 are an example of a head module.

The embodiments disclosed herein are illustrative in all aspects and should be considered to be non-restrictive. Technical features described in each of the embodiments can be combined with one another, and it is intended that the scope of the disclosure includes all the modifications within the scope of the claims and a scope equivalent to the scope of the claims.

What is claimed is:

1. A control system to be connected to a connector of a head unit, comprising a control circuit configured to:

based on input print data, apply a first voltage signal to first driving elements of a head unit to eject liquid;

based on the input print data, apply a second voltage signal to second driving elements of the head unit to eject liquid;

change the first voltage signal to a third voltage signal in a first time;

change the second voltage signal to a fourth voltage signal in a second time different from the first time;

based on the input print data, apply the third voltage signal to the first driving elements to eject liquid; and based on the input print data, apply the fourth voltage signal to the second driving elements to eject liquid.

2. The control system of claim 1, wherein the first driving elements comprises a first number of driving elements and the second driving elements comprises a second number of driving elements, and wherein the first time and the second time are based on the first number of driving elements and the second number of driving elements.

3. The control system of claim 2, wherein the control circuit is configured to:

based on the input print data, apply a fifth voltage signal to third driving elements of the head unit to eject liquid;

change the fifth voltage signal to a sixth voltage signal in a third time; and based on the input print data, apply the sixth voltage signal to the third driving elements to eject liquid, wherein the first time, the second time and the third time are based on the first number of driving elements, the second number of driving elements and the third number of driving elements.

4. The control system of claim 2, wherein the first number of driving elements is greater than the second number of driving elements, wherein the first time is earlier than the second time.

5. The control system of claim 4, wherein the first time is longer than the second time.

6. The control system of claim 2, wherein the first number of driving elements is greater than a predetermined number, and wherein the first time includes at a timing when, based on the input print data, the first driving element are not driven to eject liquid.

7. The control system of claim 6, wherein the first number of driving elements is less than the predetermined number, and wherein the first time includes at a timing when, based on the input print data, the first driving elements are driven to eject liquid.

8. The control system of claim 1, wherein the control circuit is configured to, based on the input data, determine a number of the first driving elements in use and a number of the second driving elements in use, wherein the first time and the second time are based on the determined number of the first driving elements in use and the determined number of the second driving elements in use.

9. The control system of claim 8, wherein the determined number of the first driving elements in use is greater than the determined number of the second driving elements in use, wherein the first time is earlier than the second time.

10. The control system of claim 1, wherein the first time and second time are based on a voltage level of the first voltage signal and a voltage level of the second voltage signal.

11. The control system of claim 10, wherein the voltage level of the first voltage signal is higher than the voltage level of the second voltage signal, wherein the first time is earlier than the second time.

12. The control system of claim 11, further comprising:

wherein the control circuit is configured to:

based on the input print data, apply a fifth voltage signal to third driving elements of the head unit to eject liquid;

change the fifth voltage signal to a sixth voltage signal in a third time; and based on the input print data, apply the sixth voltage signal to the third driving elements to eject liquid wherein the voltage level of the first voltage signal is between the voltage level of the second voltage signal and a voltage level of the fifth voltage signal, wherein the first time is earlier than the second time and the third time.

13. The control system of the claim 12, wherein the first number of driving elements is greater than the second number of driving elements and the third number of driving elements.

14. The control system of the claim 1, wherein the control circuit is configured to:

receive an input from a temperature sensor indicating a temperature of the liquid to be ejected by the first and second driving elements;

based on the input indicating the temperature of the liquid from the temperature sensor, control the first power supply circuit to change the first voltage to the third voltage in the first time; and based on the input indicating the temperature of the liquid from the temperature sensor, control the second power supply circuit to change the second voltage to the fourth voltage in the second time.

15. The control system of the claim 14, wherein the control circuit is configured to:

based on the input indicating the temperature of the liquid from the temperature sensor, control the first power supply circuit to change the first voltage to the third voltage incrementally in the first time; and based on the input indicating the temperature of the liquid from the temperature sensor, control the second power supply circuit to change the second voltage to the fourth voltage incrementally in the second time.

16. The control system of claim 15, wherein the control circuit is configured to:

store the input indicating the temperature of the liquid in a memory over time; and based on a difference between a latest the input indicating the temperature of the liquid stored in the memory and the input indicating the temperature of the liquid from the temperature sensor, adjust an incremental time to change the first voltage signal to the third voltage signal, and to change the second voltage signal to the fourth voltage signal.

17. The control system of claim 16, wherein the incremental time is directly proportional to the difference between the latest ink temperature stored in the memory and the detected ink temperature.

18. The control system of the claim 1, wherein:

the control circuit includes a field-programmable gate array;

the control circuit includes a memory storing bit stream information, the bit stream information, when executed by the FPGA, causing the FPGA to:

based on the input print data, apply the first voltage to the first driving elements to eject liquid;

based on the input print data, apply the second voltage to the second driving elements to eject liquid;

change the first voltage to the third voltage in the first time;

change the second voltage to the fourth voltage in the second time different from the first time;

based on the input print data, apply the third voltage to the first driving elements to eject liquid; and based on the input print data, apply the fourth voltage to the second driving elements to eject liquid.

19. The control system of claim 1, further comprising:

the first power supply circuit coupled to receive an output of the control circuit; and the second power supply circuit coupled to receive the output of the control circuit.

20. The control system of claim 1, wherein the first and third voltages are applied from a first power supply circuit; and wherein the second and fourth voltages are applied from a second power supply circuit.

21. The control system of claim 20, wherein the control circuit is configured to:

control the first power supply circuit to change the first voltage to the third voltage in the first time; and control the second power supply circuit to change the second voltage to the fourth voltage in the second time.

22. The control system of claim 21, wherein the control circuit is configured to in advance of the receipt of the input print data, connect the first power supply circuit to the first driving elements;

in advance of the receipt of the input print data, connect the second power supply circuit to the second driving elements.

23. The control system of claim 21, further comprising:

the first power supply circuit coupled to receive an output of the control circuit; and the second power supply circuit coupled to receive the output of the control circuit.

24. A head module comprising:

the head unit including the connector electrically connected to the first and second driving elements, and the control system of the claim 1 electrically connected to the connector.

25. A printing apparatus comprising a plurality of the head module of the claim 24.

26. A method implemented by a control circuit of a control system to be electrically connected to a head unit, comprising:

based on input print data, applying a first voltage to the first driving elements to eject liquid;

based on the input print data, applying a second voltage to the second driving elements to eject liquid;

changing the first voltage to a third voltage in a first time;

changing the second voltage to a fourth voltage in a second time different from the first time;

based on the input print data, applying the third voltage to the first driving elements to eject liquid; and based on the input print data, applying the fourth voltage to the second driving elements to eject liquid.

27. A head module comprising:

first driving elements;

second driving elements;

a first power supply circuit;

a second power supply circuit; and a control circuit configured to:

based on input print data, apply a first voltage signal from the first power supply circuit to the first driving elements to eject liquid;

based on the input print data, apply a second voltage signal from the second power supply circuit to the second driving elements to eject liquid;

control the first power supply circuit to change the first voltage signal to a third voltage signal in a first time;

control the second power supply circuit to change the second voltage signal to a fourth voltage signal in a second time different from the first time;

based on the input print data, apply the third voltage from the first power supply circuit to the first driving elements to eject liquid; and based on the input print data, apply the fourth voltage from the second power supply circuit to the second driving elements to eject liquid.

28. A control system to be connected to a connector of a head unit, comprising a control circuit configured to:

based on input print data, apply a first signal from a first signal supply to first driving elements of a head unit to eject liquid;

based on the input print data, apply a second signal from a second signal supply to second driving elements of the head unit to eject liquid;

control the first signal supply to change the first signal to a third signal in a first time;

control the second signal supply to change the second signal to a fourth signal in a second time different from the first time;

based on the input print data, apply the third signal to the first driving elements to eject liquid; and based on the input print data, apply the fourth signal to the second driving elements to eject liquid.

* * * * *